US008977172B2

(12) United States Patent
Yoshimura

(10) Patent No.: US 8,977,172 B2
(45) Date of Patent: Mar. 10, 2015

(54) FIXING APPARATUS HAVING AN AIR BLOWING MECHANISM

(71) Applicant: Canon Kabushiki Kaisha, Tokyo (JP)

(72) Inventor: Tomohiko Yoshimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/797,518

(22) Filed: Mar. 12, 2013

(65) Prior Publication Data

US 2013/0266349 A1 Oct. 10, 2013

(30) Foreign Application Priority Data

Apr. 6, 2012 (JP) ..... 2012-087255

(51) Int. Cl.
*G03G 15/20* (2006.01)
*G03G 15/00* (2006.01)

(52) U.S. Cl.
CPC ..... *G03G 15/6585* (2013.01); *G03G 15/2064* (2013.01)
USPC ..... 399/320; 399/92; 399/327

(58) Field of Classification Search
CPC ..... G03G 15/20; G03G 15/2017; G03G 15/2025; G03G 15/2064; G03G 15/2075; G03G 2215/20; G03G 2215/2016
USPC ..... 399/67, 320, 327, 328, 329, 92
See application file for complete search history.

(56) References Cited

U.S. PATENT DOCUMENTS

| | | | | |
|---|---|---|---|---|
| 2005/0185978 | A1* | 8/2005 | Kemmochi | |
| 2006/0024097 | A1* | 2/2006 | Yamada et al. | 399/327 |
| 2009/0297233 | A1* | 12/2009 | Kameda | 399/322 |
| 2013/0058672 | A1* | 3/2013 | Takada et al. | 399/67 |
| 2013/0136480 | A1* | 5/2013 | Hasegawa | 399/69 |
| 2013/0164054 | A1* | 6/2013 | Hayashi et al. | 399/329 |

FOREIGN PATENT DOCUMENTS

| | | | |
|---|---|---|---|
| JP | 56-087075 A | * | 7/1981 |
| JP | 2008-040363 A | | 2/2008 |

* cited by examiner

*Primary Examiner* — Sophia S Chen
(74) *Attorney, Agent, or Firm* — Canon USA Inc IP Division

(57) ABSTRACT

A fixing apparatus includes first and second fixing rotatable members configured to fix a toner image on a sheet at a nip portion therebetween, a rubbing rotatable member configured to rub an outer surface of the first fixing rotatable member, a moving mechanism configured to move the rubbing rotatable member between a contact position, in which the rubbing rotatable member is in contact with the outer surface of the first fixing rotatable member, and a separate position, in which the rubbing rotatable member is away from the outer surface of the first fixing rotatable member, and an air blowing mechanism configured to blow air to between the rubbing rotatable member and the first fixing rotatable member at least when the rubbing rotatable member moves from the contact position to the separate position.

10 Claims, 18 Drawing Sheets

· LOWER BELT ASSEMBLY B: PRESSURE POSITION
· ROUGHING ROLLER 400: SEPARATE POSITION (FIRST POSITION)

· LOWER BELT ASSEMBLY B: SEPARATE POSITION
· ROUGHING ROLLER 400: SEPARATE POSITION (FIRST POSITION)

· ROUGHING ROLLER 400: PRESSURE POSITION (SECOND POSITION)

FIXING APPARATUS HAVING AN AIR BLOWING MECHANISM

BACKGROUND OF THE INVENTION

1. Field of the Invention

The present invention relates to a fixing apparatus which fixes a toner image on a sheet. The fixing apparatus can be used, for example, in an image forming apparatus like a copying machine, a printer, a facsimile (FAX), and a multi-function peripheral having a plurality of such functions.

2. Description of the Related Art

An image forming apparatus using an electrophotographic method conventionally includes a fixing apparatus which fixes a toner image formed on recording material (sheet) at a nip portion between two fixing members (first and second fixing rotatable members). A lot of toners with improved fusibility have recently been developed. With improved fusibility, toner can be uniformly and favorably melted by a fixing apparatus. This makes the fixed toner layer more uniform and smoother for improved image glossiness.

As a result, an image having higher glossiness and higher image quality than heretofore can be formed on high gloss recording material such as coated paper.

As the fixing apparatus repeats fixing processing, the fixing members tend to be deteriorated in surface properties by edge portions of recording material (both ends in a direction orthogonal to a conveyance direction of the recording material) as compared to other areas. Specifically, the areas touched by the edge portions of recording material tend to be roughened in the surface as compared to the other areas. Such uneven surface properties of the fixing members can appear on the fixed image as uneven image glossiness.

An apparatus discussed in Japanese Patent Application Laid-Open No. 2008-040363 includes a roughing roller (rubbing rotatable member) which rubs the surface of a fixing member. Specifically, the roughing roller rubs the fixing member to make a deteriorated state (surface roughness) of the areas touched by the edge portions of recording material less noticeable as compared to the other areas.

When the roughing processing by the roughing roller finishes and the roughing roller is separated from the fixing member, a line of shavings produced by the roughing processing can appear on the fixing member. Such shavings interfere with favorable fixing processing next time. Specifically, a line of shavings can appear on an image to cause a decrease in image quality.

SUMMARY OF THE INVENTION

The present invention is directed to a fixing apparatus that can diffuse a line of shavings produced by rubbing processing.

The present invention is further directed to a fixing apparatus that can suppress a decrease in image quality due to a line of shavings produced by the rubbing processing.

According to an aspect of the present invention, a fixing apparatus includes first and second fixing rotatable members configured to fix a toner image on a sheet at a nip portion therebetween, a rubbing rotatable member configured to rub an outer surface of the first fixing rotatable member, a moving mechanism configured to move the rubbing rotatable member between a contact position, in which the rubbing rotatable member is in contact with the outer surface of the first fixing rotatable member, and a separate position, in which the rubbing rotatable member is away from the outer surface of the first fixing rotatable member, and an air blowing mechanism configured to blow air to between the rubbing rotatable member and the first fixing rotatable member at least when the rubbing rotatable member moves from the contact position to the separate position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

(1) Image Forming Apparatus

Figure 1:
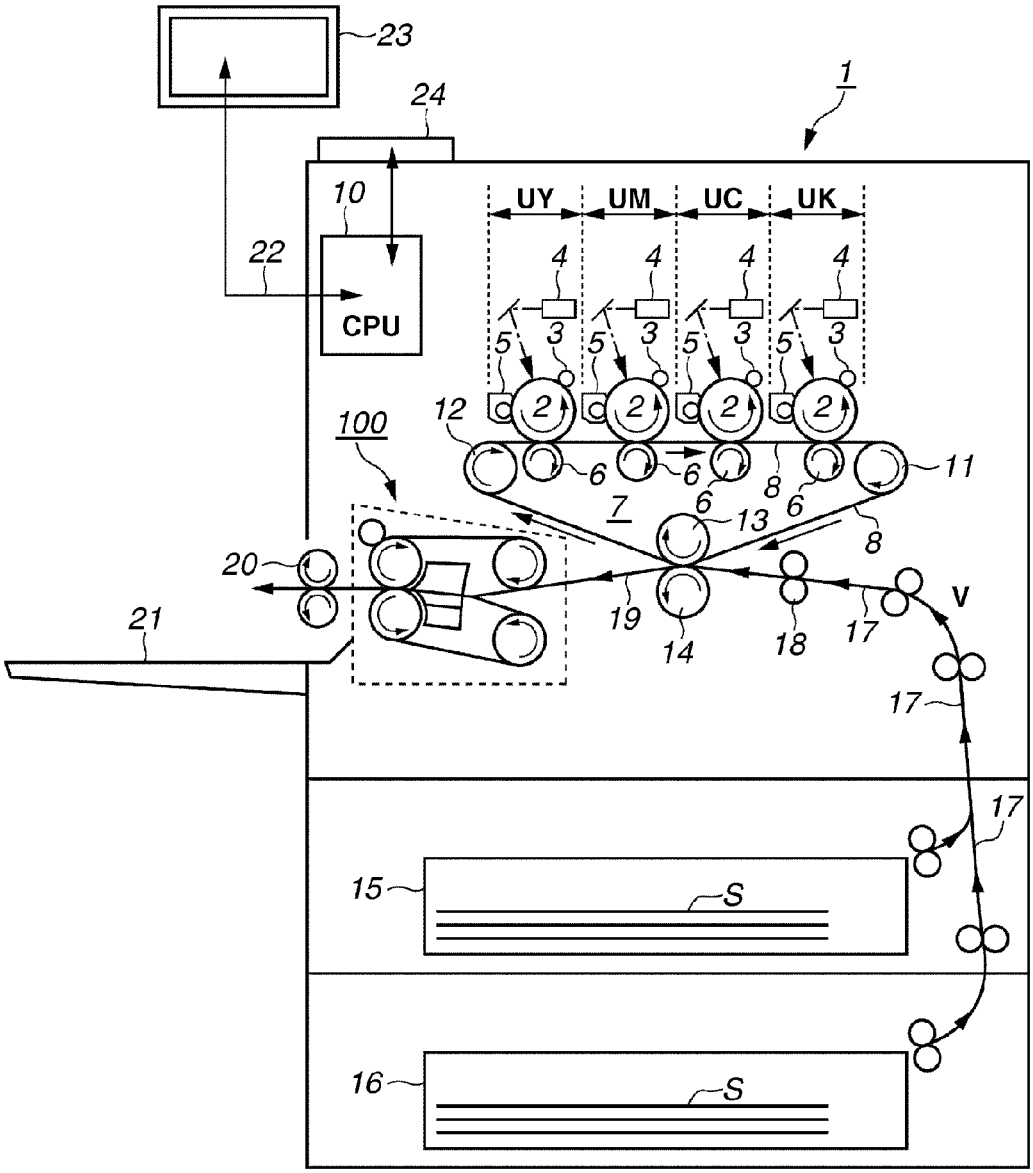
FIG. 1 is a sectional view illustrating an image forming apparatus according to a first exemplary embodiment.

FIG. 1 is a schematic block diagram of an image forming apparatus 1 according to the present exemplary embodiment. FIG. 1 illustrates a schematic sectional view taken along a conveyance direction V of a sheet (recording material) S. The image forming apparatus 1 is a full color electrophotographic printer (hereinafter, referred to as a printer) using an intermediate transfer member. The printer 1 can form an image corresponding to image data (electrical image information) input from an external host apparatus 23 on the sheet S to output an image formation product. The external host apparatus 23 is connected to a printer control unit (hereinafter, referred to as a central processing unit (CPU)) 10 via an interface 22.

The CPU 10 is a control unit that controls an operation of the printer 1 in a comprehensive manner. The CPU 10 exchanges various electrical information signals with the external host apparatus 23 and a printer operation unit 24. The CPU 10 further processes electrical information signals input from various process devices and sensors, processes command signals for various process devices, and performs predetermined initial sequence control and predetermined image forming sequence control. Examples of the external host apparatus 23 include a personal computer, a network, an image reader, and a facsimile.

The printer 1 includes first to fourth, four image forming units U (UY, UM, UC, and UK) which are arranged in parallel from left to right in the diagram. The image forming units UY, UM, UC, and UK are electrophotographic image forming mechanisms having similar configurations, with the only difference in that their developing units 5 contain developers or toners of different colors, namely, yellow (Y), magenta (MA), cyan (C), and black (BL), respectively.

Each image forming unit U includes an electrophotographic photosensitive member (hereinafter, referred to as a drum) 2, and process units acting on the drum 2, including a charging roller 3, a laser scanner 4, a developing unit 5, and a primary transfer roller 6.

The drums 2 of the image forming units U are driven to rotate in the respective arrowed counterclockwise directions at a predetermined speed. A Y color toner image corresponding to a Y color component image of a full color image to be formed is formed on the drum 2 of the first image forming unit UY. An MA color toner image corresponding to an MA color component image is formed on the drum 2 of the second image forming unit UM. A C color toner image corresponding to a C color component image is formed on the drum 2 of the third image forming unit UC. A BL color toner image corresponding to a BL color component image is formed on the drum 2 of the fourth image forming unit UK. The toner images are formed on the drums 2 of the image forming units U by known forming processes and principles. A description thereof will thus be omitted.

An intermediate transfer belt unit 7 is arranged below the image forming units U. The intermediate transfer belt unit 7 includes a flexible endless intermediate transfer belt 8 serving as an intermediate transfer member. The intermediate transfer belt 8 is wound and stretched across three rollers, including a drive roller 11, a tension roller 12, and a secondary transfer counter roller 13. The drive roller 11 is driven to move the intermediate transfer belt 8 to circulate in the arrowed clockwise direction at a speed corresponding to the rotation speed of the drums 2. A secondary transfer roller 14 is put into contact with the secondary transfer counter roller 13 by a predetermined pressing force with the intermediate transfer belt 8 therebetween. A contact portion between the intermediate transfer belt 8 and the secondary transfer roller 14 forms a secondary transfer nip portion.

The primary transfer rollers 6 of the image forming units U are arranged inside the intermediate transfer belt 8, and are in contact with lower surfaces of the respective drums 2 via the intermediate transfer belt 8. In each image forming unit U, a contact portion between the drum 2 and the intermediate transfer belt 8 forms a primary transfer nip portion. A predetermined primary transfer bias is applied to the primary transfer rollers 6 at predetermined control timing.

The Y color toner, MA color toner, C color toner, and BL color toner formed on the drums 2 of the respective image forming units U are successively superimposed and primary-transferred onto the surface of the moving and circulating intermediate transfer belt 8 at the respective primary transfer nip portions. As a result, a four-color superimposed, unfixed full color toner image is combined and formed on the intermediate transfer belt 8. The unfixed full color toner image is conveyed to the secondary transfer nip portion.

One of sheets S accommodated in a first or second sheet cassette 15 or 16 is separated and fed by an operation of a sheet feeding mechanism and conveyed to a registration roller pair 18 through a conveyance path 17. The registration roller pair 18 once receives the sheet S, and if the sheet S is skewed, straightens the sheet S. The registration roller pair 18 conveys the sheet S to the secondary transfer nip portion in synchronization with the full color toner image on the intermediate transfer belt 8.

While the sheet S is pinched and conveyed by the secondary transfer nip portion, a predetermined secondary transfer bias is applied to the secondary transfer roller 14. The entire full color toner image on the intermediate transfer belt 8 is thereby secondary-transferred to the sheet S in order. The sheet S past the secondary transfer nip portion is separated from the surface of the intermediate transfer belt 8, passed through a conveyance path 19, and introduced into an image heating and fixing apparatus (hereinafter, referred to as a fixing apparatus) 100 serving as an image processing apparatus. The fixing apparatus 100 heats and presses the sheet S to fix the unfixed full color toner image into a fixed image. The sheet S past the fixing apparatus 100 is conveyed and discharged by a discharge roller pair 20 to a discharge tray 21 as a full color image formation product.

(2) Fixing Apparatus 100

Figure 2:
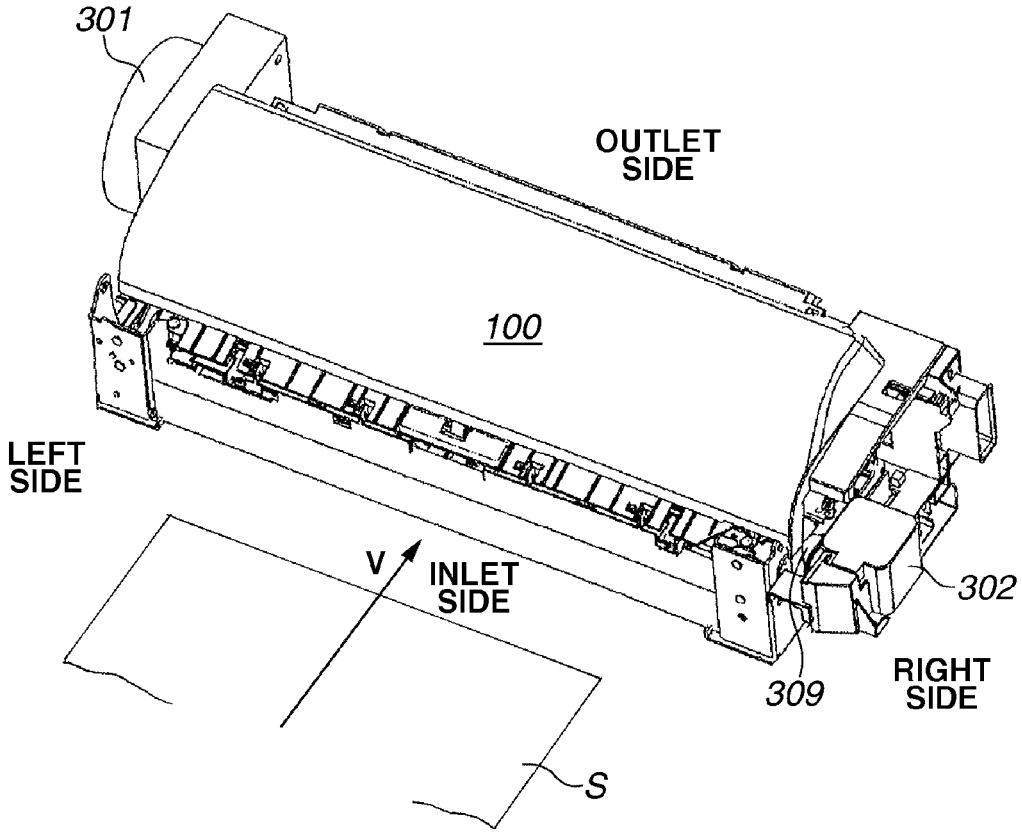
FIG. 2 is a perspective view illustrating an appearance of a fixing apparatus according to the first exemplary embodiment.
Figure 3:
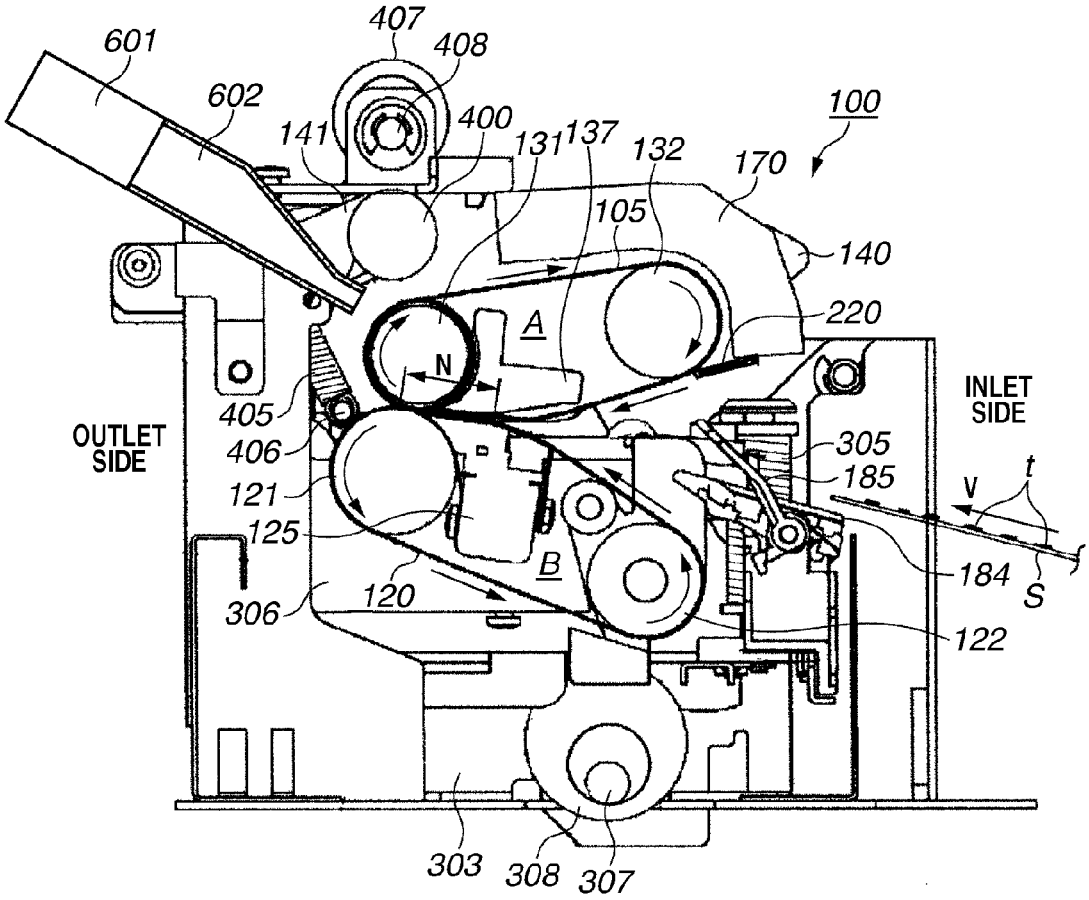
FIG. 3 is a cross-sectional left side view of essential parts of the fixing apparatus (when a lower belt assembly is in a pressure state).
Figure 4:
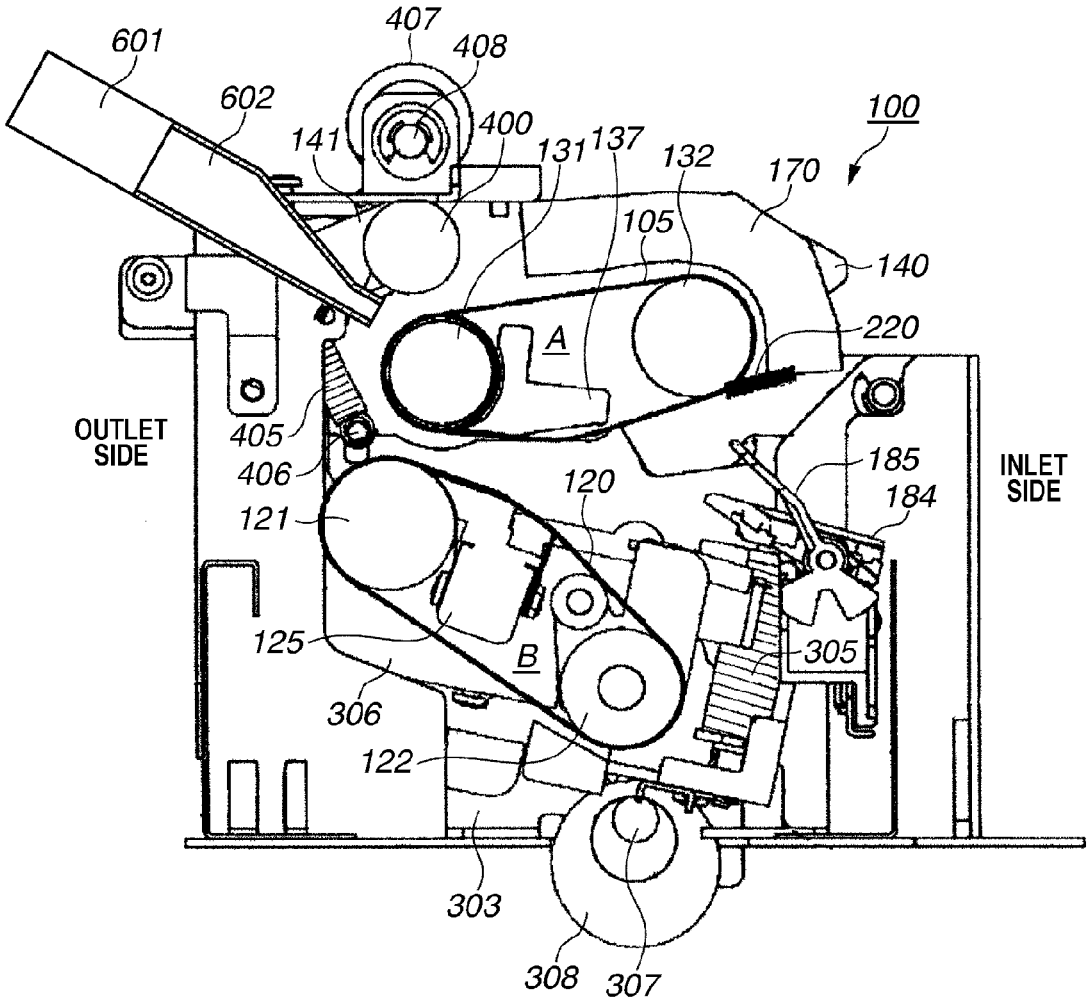
FIG. 4 is a cross-sectional left side view of essential parts of the fixing apparatus (when the lower belt assembly is in a separate state).
Figure 5:
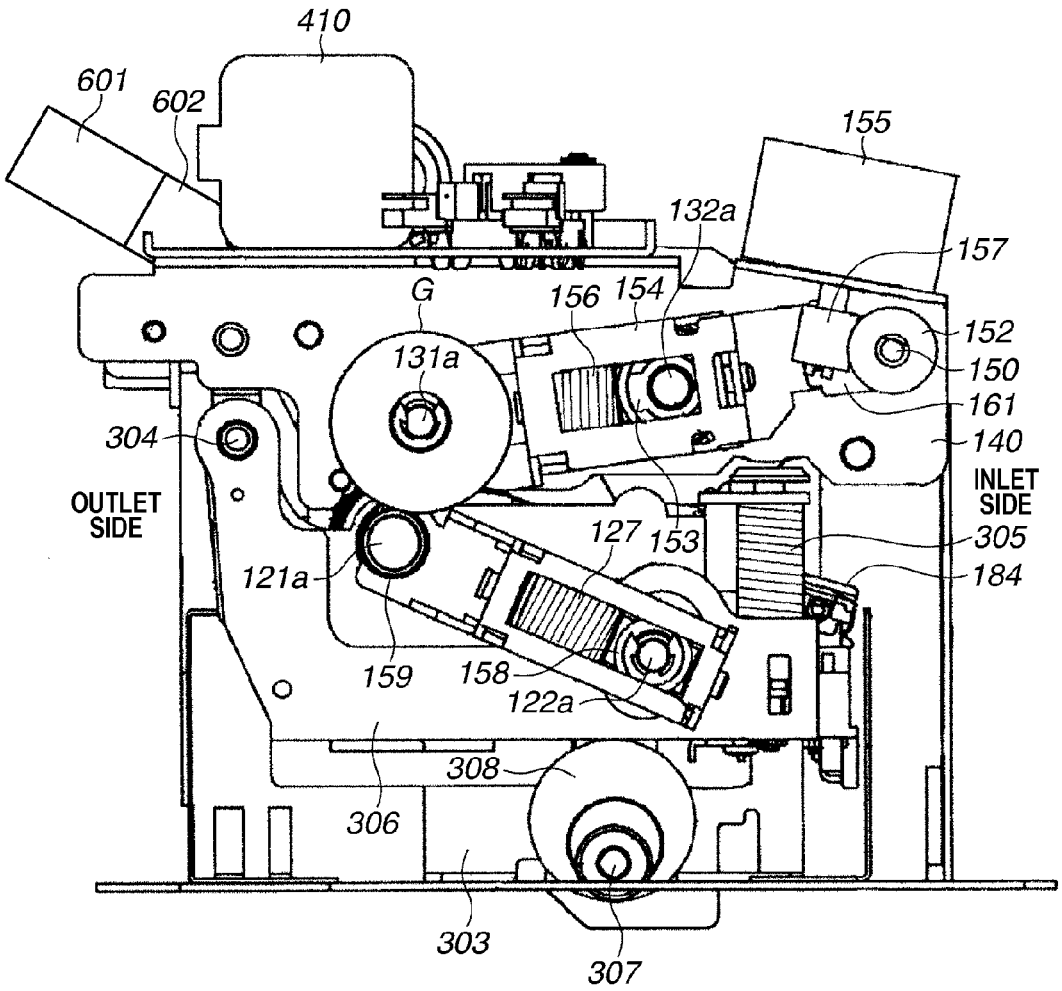
FIG. 5 is a left side view of essential parts of the fixing apparatus (when the lower belt assembly is in the pressure state).
Figure 6:
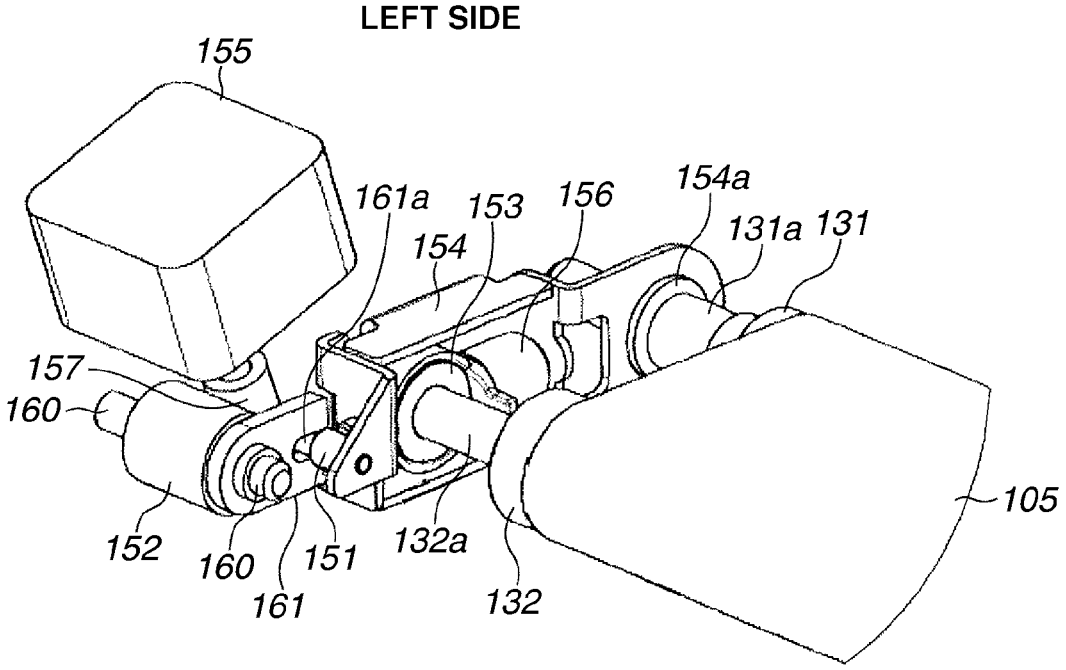
FIG. 6 is a perspective view of a belt deviation control mechanism portion.

FIG. 2 is a perspective view illustrating an appearance of the fixing apparatus 100 according to the present exemplary embodiment. FIG. 3 is a cross-sectional left side view of essential parts of the fixing apparatus 100. FIG. 3 illustrates a case where a lower belt assembly B is in a pressure state. FIG. 4 is a cross-sectional left side view of essential parts of the fixing apparatus 100. FIG. 4 illustrates a case where the lower belt assembly B is in a pressure-released state. FIG. 5 is a left side view of essential parts of the fixing apparatus 100. FIG. 5 illustrates the case where the lower belt assembly B is in the pressure state. FIG. 6 is a perspective view of a belt deviation control mechanism portion.

As employed herein, a longitudinal direction (longitudinal length) or width direction (width) of the fixing apparatus 100 or a member constituting the fixing apparatus 100 refers to a direction (or a dimension in the direction) that is parallel to a direction orthogonal to the conveyance direction V of a sheet S in the plane of the sheet conveyance path of the fixing apparatus 100. A lateral direction (lateral length) refers to a direction (or a dimension in the direction) that is parallel to the conveyance direction V of the sheet S in the plane of the sheet conveyance path of the fixing apparatus 100.

A front of the fixing apparatus 100 refers to a plane on a sheet inlet side. A back of the fixing apparatus 100 refers to a plane on a sheet outlet side. The right and left refer to the right and left of the fixing apparatus 100 when seen from the front, respectively. In the present exemplary embodiment, the left side is referred to as a near side, and the right side a far side. Above and below refer to above and below in the direction of the gravitational force, respectively. Upstream and downstream refer to upstream and downstream in the conveyance direction V of the sheet S, respectively. The width of a belt or sheet S refers to the dimension in the direction orthogonal to the conveyance direction V of the sheet S.

The fixing apparatus 100 according to the present exemplary embodiment is an image heating apparatus of a belt nip method, an electromagnetic induction heating (IH) method, or an oilless fixing method.

The fixing apparatus 100 includes an upper belt assembly A serving as a heating unit and the lower belt assembly B serving as a pressure unit. The fixing apparatus 100 further includes a pressure-separation mechanism (contacting/separating unit) for pressing and separating the lower belt assembly B against/from the upper belt assembly A. The fixing apparatus 100 further includes an IH heater (magnetic flux generation unit) 170, a deviation control mechanism of the fixing belt 105, and a roughing mechanism (surface property recovery mechanism). The IH heater 170 is a heating mechanism that heats the fixing belt 105 of the upper belt assembly A. The roughing mechanism recovers surface properties of the fixing belt 105. Such components will be described in order below.

(2-1) Upper Belt Assembly A and IH Heater 170

The upper belt assembly A is arranged between right and left upper side plates 140 of an apparatus casing. The upper belt assembly A includes a flexible fixing belt (endless belt) 105. The fixing belt 105 includes a release layer (parting layer) on its surface and serves as a fixing rotatable member (fixing member) located opposite an image bearing surface of the sheet S. The upper belt assembly A further includes a plurality of belt stretching members across which the fixing belt 105 is stretched. The belt stretching members include a drive roller (support roller) 131, a steering roller 132, and a pad stay 137. The steering roller 132 also serves as a tension roller.

The drive roller 131 is arranged on the sheet outlet side between the right and left upper side plates 140. Right and left shaft portions 131*a* of the drive roller 131 are rotatably supported between the right and left upper side plates 140 via respective bearings (not illustrated).

Steering roller support arms 154 are arranged onside the right and left upper side plates 140, respectively. The steering roller support arms 154 extend from the side of the drive roller 131 to the sheet inlet side. The right steering roller support arm 154 (not illustrated) is fixed to the right upper side plate 140 (not illustrated). Referring to FIG. 6, the left steering roller support arm 154 is supported by the left shaft portion 131*a* of the drive roller 131 via a bearing 154*a*. The left steering roller support arm 154 is vertically swingable about the left shaft portion 131*a*. A pin 151 is formed on a free end of the left steering roller support arm 154. A shaft 160 is formed on an outside surface of the left upper side plate 140 on the sheet inlet side.

A worm wheel (helical gear) 152 is rotatably supported by the shaft 160. A fork plate 161 having a U-shaped groove 161*a* is integrally formed on the worm wheel 152. The pin 151 of the left steering roller support arm 154 is engaged with the groove 161*a* of the fork plate 161. A stepping motor 155 is arranged on the upper side plate 140. A worm 157 fixed to a rotation shaft of the stepping motor 155 meshes with the worm wheel 152.

The stepping motor 155 is driven forward or backward to rotate the fork plate 161 upward or downward via the worm 157 and the worm wheel 152. In response, the left steering roller support arm 154 rotates upward or downward about the shaft portion 131*a*.

The steering roller 132 is arranged on the sheet inlet side between the right and left upper side plates 140. Right and left shaft portions 132*a* of the steering roller 132 are rotatably supported by the right and left steering roller support arms 154 via bearings 153, respectively. The bearings 153 are supported by the steering roller support arms 154 slidably and movably in a belt tension direction. The bearings 153 are biased by tension springs 156 to move in a direction away from the drive roller 131.

The pad stay 137 is a member made of stainless steel (SUS material), for example. Both right and left ends of the pad stay 137 are fixed to the right and left upper side plates 140. The pad stay 137 is thereby supported inside the fixing belt 105, close to the drive roller 131 between the drive roller 131 and the steering roller 132, with its pad surface downward.

The fixing belt 105 laid across the drive roller 131, the steering roller 132, and the pad stay 137 undergoes predetermined tension (tensile force) from the movement of the steering roller 132 in the belt tension direction, caused by the biasing forces of the tension springs 156. In the present exemplary embodiment, a tension of 200 N is applied to the fixing belt 105. An inner surface of a descending belt portion of the fixing belt 105 is put in contact with the downward pad surface of the pad stay 137.

Any fixing belt 105 that can be heated by the IH heater 170 and has heat resistance may be selected as appropriate. For example, a nickel metal layer, stainless steel layer, or other magnetic metal layer having a thickness of 75 μm, a width of 380 mm, and a circumferential length of 200 mm, coated with a 300-μm-thick silicon rubber and covered with a perfluoroalkoxy (PFA) tube as a surface layer (release layer), is used.

An example of the drive roller 131 is a solid roller made of stainless steel with an outer diameter of ϕ18, surfaced with a heat-resistant silicon rubber elastic layer formed by integral molding. The drive roller 131 is arranged on the sheet outlet side of a nip area of a fixing nip portion N which is formed between the fixing belt 105 and the pressure belt 120 serving as a second fixing rotatable member to be described below. The elastic layer is elastically distorted by a predetermined amount by pressure contact of a pressure roller 121.

In the present exemplary embodiment, the drive roller 131 and the pressure roller 121 form a nip of generally straight shape with the fixing belt 105 and the pressure belt 120 therebetween. However, the drive roller 131 and the pressure roller 121 may have various crown shapes. For example, the drive roller 131 and the pressure roller 121 may be intentionally configured with a concave crown shape to control buckling of the sheet S ascribable to differences in the speed of the sheet S within the fixing nip portion N.

An example of the steering roller 132 is a hollow roller of stainless steel with an outer diameter of ϕ20 and an inner diameter of ϕ18 or so. The steering roller 132 functions as a tension roller that stretches and tensions the fixing belt 105. The deviation control mechanism to be described below controls a tilt of the steering roller 132, whereby the steering roller 132 functions as a steering roller for adjusting deviations of the fixing belt 105 in the width direction orthogonal to the moving direction of the fixing belt 105.

A drive input gear G is coaxially fixed and arranged on the left side of the left shaft portion 131*a* of the drive roller 131. A drive motor 301 (FIG. 2) inputs a drive to the drive input gear G through a drive transmission unit (not illustrated), whereby the drive roller 131 is driven to rotate in the arrowed clockwise direction in FIG. 4 at a predetermined speed.

The rotation of the drive roller 131 conveys the fixing belt 105 to circulate in the arrowed clockwise direction at a speed corresponding to the speed of the drive roller 131. The steering roller 132 rotates to follow the circulation and conveyance of the fixing belt 105. The inner surface of the descending belt portion of the fixing belt 105 slides and moves over the downward pad surface of the pad stay 137. For stable conveyance of the sheet S at the fixing nip portion N to be described below, the fixing belt 105 and the drive roller 131 reliably transmit a drive therebetween.

The IH heater 170 serves as a heating unit for heating the fixing belt 105. The IH heater 170 is an induction heating coil unit including an excitation coil, a magnetic core, and a holder which holds the excitation coil and the magnetic coil. The IH heater 170 is arranged above the upper belt assembly A. The IH heater 170 is fixed to the right and left upper side plates 140 so that the IH heater 170 is located opposite the fixing belt 105, or more specifically, an upper surface portion of the fixing belt 105 and a portion where the steering roller 132 lies, at a predetermined distance without contact.

An alternating current is supplied to the excitation coil of the IH heater 170 to generate an alternating-current magnetic flux. The alternating-current magnetic flux is introduced into the magnetic core to generate eddy currents in the magnetic metal layer of the fixing belt 105 serving as an induction heat generation member. The eddy currents generate Joule heat based on the specific resistance of the induction heat generation member. A thermistor 220 detects a temperature of the surface layer of the fixing belt 105. Based on temperature information from the thermistor 220, the alternating current supplied to the excitation coil is controlled so that the surface temperature of the fixing belt 105 is adjusted to approximately 140° C. to 200° C. (target temperature).

(2-2) Lower Belt Assembly B and Pressure-Separation Mechanism

The lower belt assembly B is arranged under the upper belt assembly A. The lower belt assembly B is built on a lower frame (pressure frame) 306. The lower frame 306 is vertically rotatably supported about a hinge shaft 304 which is fixed to right and left lower side plates 303 on the sheet outlet side of the fixing apparatus 100.

The lower belt assembly B includes the flexible pressure belt (endless belt) 120 serving as a fixing rotatable member (pressure member) which forms the fixing nip portion N with the fixing belt 105 of the upper belt assembly A. The lower belt assembly B further includes the pressure roller (pressure roller) 121, a tension roller 122, and a pressure pad 125, which serve as a plurality of belt suspension members across which the pressure belt 120 is suspended with tension.

Right and left shaft portions 121*a* of the pressure roller 121 are rotatably supported between right and left side plates of the lower frame 306 via respective bearings 159. Right and left shaft portions 122*a* of the tension roller 122 are rotatably supported by the right and left side plates of the lower frame 306 via bearings 158, respectively. The bearings 158 are supported by the lower frame 306 slidably and movably in a belt tension direction. The bearings 158 are biased by tension springs 127 to move in a direction away from the pressure roller 121.

An example of the pressure pad 125 is a member made of silicon rubber. Both right and left ends of the pressure pad 125 are fixed and supported between the right and left side plates of the lower frame 306. The pressure roller 121 lies on the sheet outlet side between the right and left side plates of the lower frame 306. The tension roller 122 lies on the sheet inlet side between the right and left side plates of the lower frame 306. The pressure pad 125 is not-rotatably supported and arranged inside the pressure belt 120, close to the pressure roller 121 between the pressure roller 121 and the tension roller 122, with its pad surface upward.

The pressure belt 120 laid across the pressure roller 121, the tension roller 122, and the pressure pad 125 undergoes predetermined tension (tensile force) from the movement of the tension roller 122 in the belt tension direction, caused by the biasing forces of the tension springs 127. In the present exemplary embodiment, a tension of 200 N is applied to the pressure belt 120. An inner surface of an ascending belt portion of the pressure belt 120 is put in contact with the upward pad surface of the pressure pad 125.

Any heat-resistant pressure belt 120 may be selected as appropriate. For example, a nickel metal layer having a thickness of 50 μm, a width of 380 mm, and a circumferential length of 200 mm, coated with a 300-μm-thick silicon rubber and covered with a PFA tube as a surface layer (release layer), is used. An example of the pressure roller 121 is a solid roller made of stainless steel with an outer diameter of ϕ20. An example of the tension roller 122 is a hollow roller made of stainless steel with an outer diameter of ϕ20 and an inner diameter of ϕ18 or so.

The lower belt assembly B is controlled to rotate vertically about the hinge shaft 304 by the pressure-separation mechanism serving as a contacting/separating unit. More specifically, when the lower belt assembly B is rotated and lifted up by the pressure-separation mechanism, the lower belt assembly B moves to a pressure position as illustrated in FIG. 3. When the lower belt assembly B is rotated and lifted down, the lower belt assembly B moves to a separate position as illustrated in FIG. 4.

When the lower belt assembly B is moved to the pressure position, the pressure roller 121 and the pressure pad 125 are pressed against the drive roller 131 and the pad stay 137 of the upper belt assembly A, respectively, by a predetermined pressure force with the pressure belt 120 and the fixing belt 105 therebetween. As a result, the fixing belt 105 of the upper belt assembly A and the pressure belt 120 of the lower belt assembly B form therebetween the fixing nip portion N having a predetermined width in the conveyance direction V of the sheet S. When moved to the separate position, the lower belt assembly B stops being pressed against the upper belt assembly A and is separated from the upper belt assembly A without contact.

The pressure-separation mechanism according to the present exemplary embodiment will be described. A pressure spring unit is arranged on the lower frame 306 at a side opposite from the hinge shaft 304. The pressure spring unit includes a pressure spring 305 for elastically pressing the lower belt assembly B against the upper belt assembly A.

A pressure camshaft 307 is rotatably supported between lower portions of the right and left lower side plates 303 via bearings. A pair of eccentric pressure cams 308 having the same shape and the same phase are fixed and arranged on the right and left sides of the pressure camshaft 307. The eccentric pressure cams 308 support the bottom surface of the lower frame 306. A pressure gear 309 (FIG. 2) is coaxially fixed and arranged on the right end of the pressure camshaft 307. A pressure motor 302 inputs a drive to the pressure gear 309 through a drive transmission unit (not illustrated), whereby the pressure camshaft 307 is driven to rotate.

The pressure camshaft 307 is controlled to rotate to a first rotation angle position and a second rotation angle position. In the first rotation angle position, the eccentric pressure cams 308 are situated with their large protrusions upward as illustrated in FIGS. 3 and 5. In the second rotation angle position, the eccentric pressure cams 308 are situated with their large protrusions downward as illustrated in FIG. 4.

When the pressure camshaft 307 is rotated to and stopped at the first rotation angle position, the large protrusions of the eccentric pressure cams 308 lift up the lower frame 306 on which the lower belt assembly B is mounted. The lower belt assembly B makes contact with the upper belt assembly A while compressing the pressure spring 305 of the pressure spring unit. As a result, the lower belt assembly B is elastically pressed and biased to the upper belt assembly A with a predetermined pressure (for example, 400 N) resulting from a compression reactive force of the pressure spring 305. The lower belt assembly B is held in the pressure position illustrated in FIG. 3.

The pressure contact of the pressure roller 121 with the drive roller 131 warps and deforms the drive roller 131 by several hundreds of millimeters in a direction opposite from the contacting direction to the pressure roller 121. The warpage of the drive roller 131 can cause a pressure drop in the center of the fixing nip portion N in the longitudinal direction. To avoid the pressure drop, the drive roller 131 or both the drive roller 131 and the pressure roller 121 is/are configured with a crown shape so that the drive roller 131 and the pressure roller 121 form a nip of generally straight shape. In the present exemplary embodiment, the drive roller 131 has a convex crown shape of 300 μm.

When the pressure camshaft 307 is rotated to and stopped at the second rotation angle position, the large protrusions of the eccentric pressure cams 308 are directed downward and the small protrusions face the bottom surface of the lower frame 306, whereby the lower belt assembly B is lifted down. In other words, the lower belt assembly B is held in the separate position illustrated in FIG. 4, where the lower belt assembly B stops being pressed against the upper belt assembly A and is separated from the upper belt assembly A by a predetermined distance without contact.

Figure 7A:
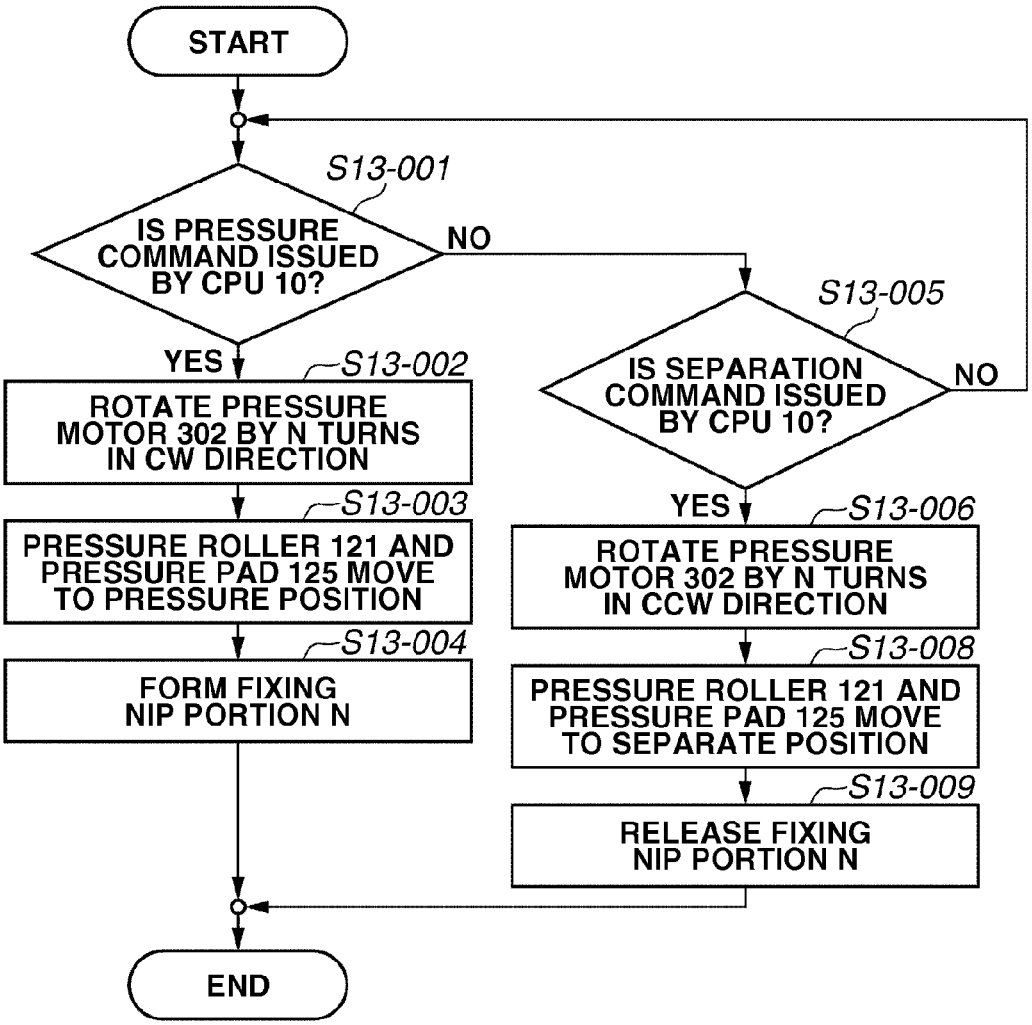
FIG. 7A is a flowchart illustrating vertical movement control of the lower belt assembly.
Figure 7B:
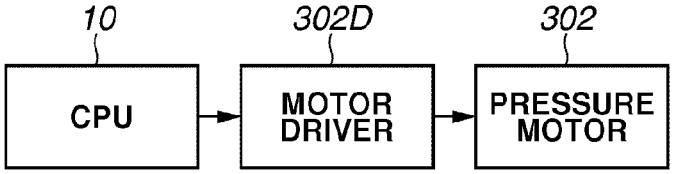
FIG. 7B is a block diagram illustrating a control system.

Vertical movement control of the lower belt assembly B will be described with reference to a control flowchart illustrated in FIG. 7A and a block diagram of a control system illustrated in FIG. 7B.

The lower belt assembly B is normally held in the separate position illustrated in FIG. 4. In step S13-001, if the CPU 10 issues a pressure command (YES in step S13-001), then in step S13-002, the CPU 10 rotates the pressure motor 302 by a predetermined number of rotations, or N turns, in a clockwise (CW) direction via a motor driver 302D. As a result, the pressure camshaft 307 is driven to rotate by a half turn. In step S13-003, the eccentric pressure cams 308 are switched from the second rotation angle position illustrated in FIG. 4 to the first rotation angle position illustrated in FIGS. 3 and 5, and the lower belt assembly B is rotated and lifted up so that the pressure roller 121 and the pressure pad 125 move to the pressure position.

More specifically, the pressure roller 121 and the pressure pad 125 are pressed against the drive roller 131 and the pad stay 137 of the upper belt assembly A by a predetermined contact pressure with the pressure belt 120 and the fixing belt 105 therebetween. In step S13-004, the fixing belt 105 and the pressure belt 120 form therebetween the fixing nip portion N having a predetermined width in the conveyance direction V of the sheet S.

If the lower belt assembly B is held in the pressure position illustrated in FIG. 3 and the CPU 10 issues a separation command (YES in step S13-005), then in step S13-006, the CPU 10 rotates the pressure motor 302 by a predetermined number of rotations, or N turns, in a counterclockwise (CCW) direction via the motor driver 302D. As a result, the pressure camshaft 307 is driven to rotate by a half turn. In step S13-008, the eccentric pressure cams 308 are switched from the first rotation angle position illustrated in FIGS. 3 and 5 to the second rotation angle position illustrated in FIG. 4. In other words, the lower belt assembly B is rotated and lifted down so that the pressure roller 121 and the pressure pad 125 move to the separate position. In step S13-009, the formation of the fixing nip portion N is released.

(2-3) Fixing Operation and Temperature Adjustment Control

Figure 8A:
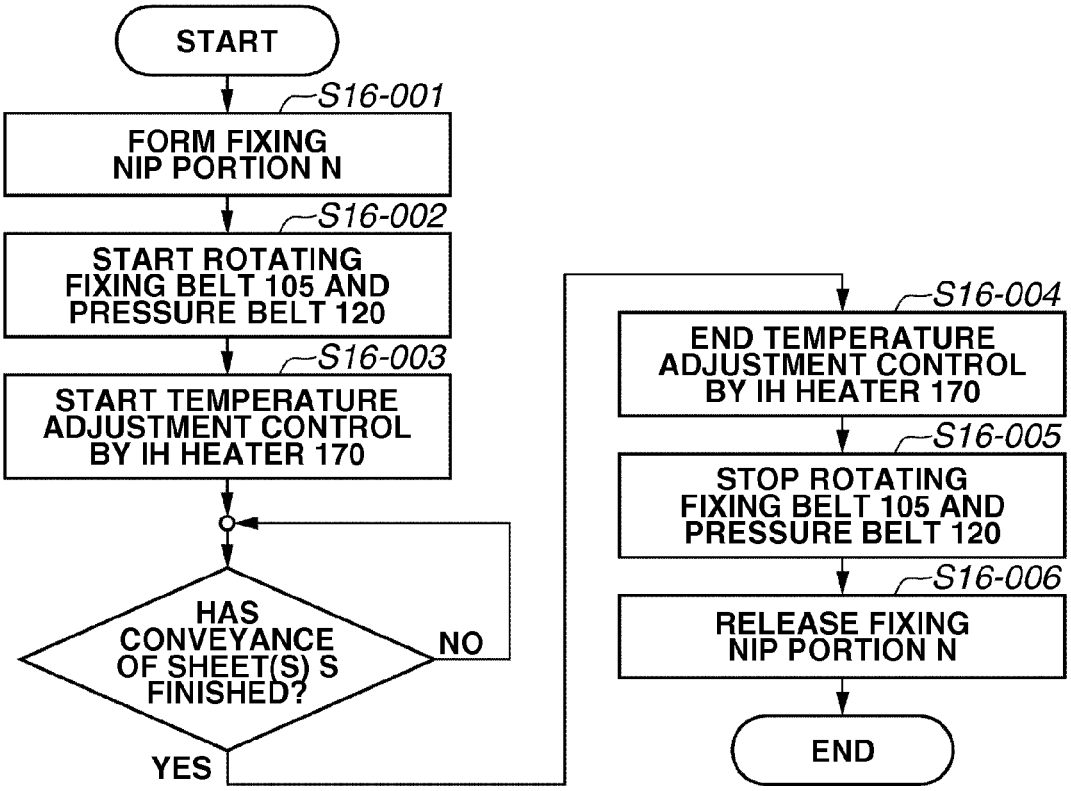
FIG. 8A is a flowchart illustrating fixing operation control of the fixing apparatus.
Figure 8B:
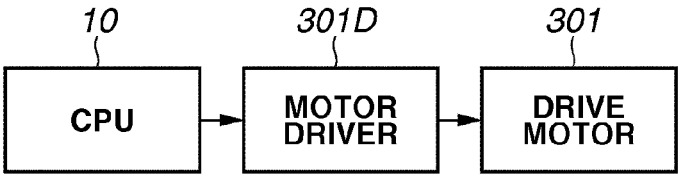
FIG. 8B is a block diagram illustrating a control system.

Next, a fixing operation of the fixing apparatus 100 will be described with reference to a control flowchart illustrated in FIG. 8A and a block diagram of a control system illustrated in FIG. 8B. When the fixing apparatus 100 is in a standby state, the lower belt assembly B is held in the separate position illustrated in FIG. 4. The drive motor 301 stops being driven. Power supply to the IH heater 170 is also stopped.

The CPU 10 starts predetermined image forming sequence control based on input of a print job start signal. The CPU 10 drives the pressure motor 302 of the fixing apparatus 100 via the motor driver 302D at predetermined control timing, whereby the pressure camshaft 307 is driven to rotate by a half turn. This moves the lower belt assembly B from the separate position illustrated in FIG. 4 to the pressure position illustrated in FIG. 3. In step S16-001, the fixing belt 105 and the pressure belt 120 form the fixing nip portion N therebetween.

Next, the CPU 10 drives the drive motor 301 via a motor driver 301D to input a drive to the drive input gear G. As a result, the drive roller 131 of the upper belt assembly A is driven as described above, and the fixing belt 105 starts to rotate.

A rotational force of the drive input gear G is also transmitted to the pressure roller 121 of the lower belt assembly B through a drive gear train (not illustrated), whereby the pressure roller 121 is driven to rotate in the arrowed counterclockwise direction in FIG. 3. In step S16-002, the pressure belt 120 starts to rotate in the arrowed counterclockwise direction because of the rotation of the pressure roller 121 and a frictional force of the rotating fixing belt 105. In the fixing nip portion N, the fixing belt 105 and the pressure belt 120 move in the same direction at almost the same moving speed.

Figure 9A:
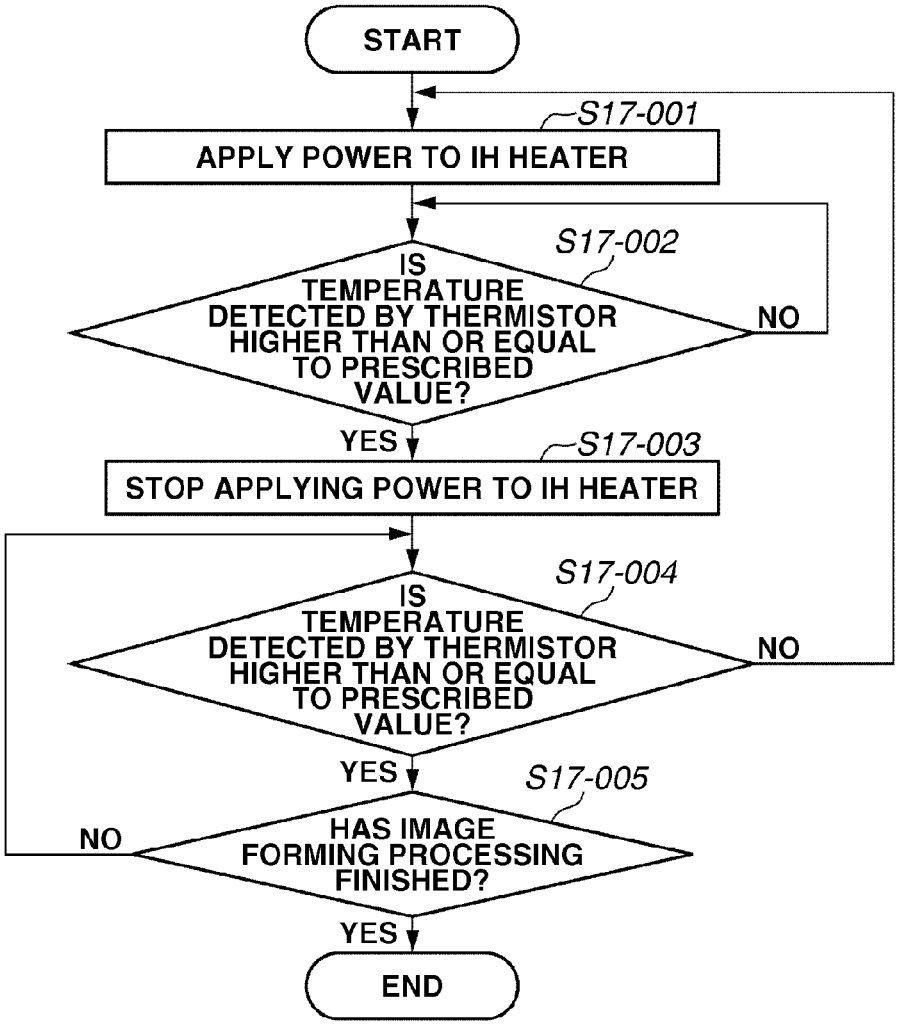
FIG. 9A is a flowchart illustrating fixing belt temperature control.
Figure 9B:
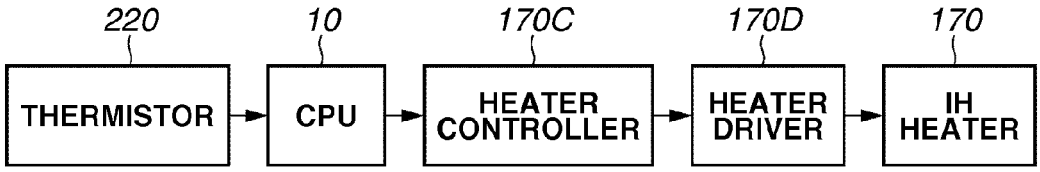
FIG. 9B is a block diagram illustrating a control system.

Next, the CPU 10 supplies power to the IH heater 170 via a heater controller 170C and a heater driver 170D (FIG. 9B). The CPU 10 thereby heats the fixing belt 105 by electromagnetic induction heating up to a predetermined target temperature and performs temperature adjustment control. More specifically, in step S16-003, the CPU 10 starts temperature adjustment control to increase and maintain the temperature of the fixing belt 105 to a target temperature of 140° C. to 200° C. according to the grammage or paper type of a sheet S to be passed.

After the formation of the fixing nip portion N, the rotation of the fixing belt 105 and the pressure belt 120, and the temperature increase and temperature adjustment of the fixing belt 105, a sheet S on which the image forming units U have formed an unfixed toner image t (FIG. 3) is introduced into the fixing apparatus 100. An inlet guide 184 arranged on a sheet inlet portion of the fixing apparatus 100 guides the sheet S to enter the fixing nip portion N, which is the pressure contact portion between the fixing belt 105 and the pressure belt 120. A flag sensor 185 including a photointerrupter is arranged on the inlet guide 184. The flag sensor 185 detects passing timing of the sheet S.

The fixing nip portion N pinches and conveys the sheet S with the image bearing surface of the sheet S located opposite the fixing belt 105 and the opposite side of the sheet S located opposite the pressure belt 120. The unfixed toner image t is fixed to the sheet surface as a fixed image by heat and a nip pressure from the fixing belt 105. The sheet S past the fixing nip portion N is separated from the surface of the fixing belt 105, and comes out from the sheet outlet side of the fixing apparatus 100. The discharge roller pair 20 (FIG. 1) conveys and discharges the sheet S to the discharge tray 21.

If the conveyance of a sheet or sheets S in a print job for a predetermined single sheet or plurality of consecutive sheets has finished, then in step S16-004, the CPU 10 ends the heating and temperature adjustment control of the fixing belt 105 and turns off the power supply to the IH heater 170. In step S16-005, the CPU 10 turns off the drive motor 301 to stop rotating the fixing belt 105 and the pressure belt 120.

The CPU 10 drives the pressure motor 302 via the motor driver 302D, whereby the pressure camshaft 307 is driven to rotate by a half turn. This moves the lower belt assembly B from the pressure position illustrated in FIG. 3 to the separate position illustrated in FIG. 4. In step S16-006, the fixing nip portion N between the fixing belt 105 and the pressure belt 120 is thus released. In such a state, the CPU 10 waits for the input of a next print job start signal.

Temperature control of the fixing belt 105 will be described with reference to a control flowchart illustrated in FIG. 9A and a block diagram of a control system illustrated in FIG. 9B. The upper belt assembly A includes the thermistor 220, which serves as a temperature detection member for detecting the surface temperature of the fixing belt 105. In step S17-001, the CPU 10 applies power to the IH heater 170 via the heater controller 170C and the heater driver 170D at predetermined control timing based on the input of a print job start signal. The IH heater 170 increases the temperature of the fixing belt 105 by electromagnetic induction heating.

The thermistor 220 detects the temperature of the fixing belt 105, and inputs detection temperature information (electrical information about temperature) to the CPU 10. If the temperature detected by the thermistor 220 becomes higher than or equal to a predetermined prescribed value (target temperature) (YES in step S17-002), then in step S17-003, the CPU 10 stops the power to the IH heater 170. Subsequently, if the temperature detected by the thermistor 220 becomes lower than the predetermined prescribed value (NO in step S17-004), then in step S17-001, the CPU 10 resumes the application of the power to the IH heater 170.

The CPU 10 repeats the foregoing steps S17-001 to S17-004 to adjust and maintain the temperature of the fixing belt 105 to the predetermined target temperature. Such fixing belt temperature adjustment control is performed until a print job for a predetermined single sheet or plurality of consecutive sheets finishes (YES in step S17-005).

(2-4) Belt Deviation Control Mechanism

The fixing belt 105, when rotating, causes a phenomenon of moving closer to one side or the other in the width direction orthogonal to the conveyance direction V of the sheet S. Such a phenomenon will be referred to as a belt deviation movement. The pressure belt 120, pressed into contact with the fixing belt 105 to form the fixing nip portion N, also makes a deviation movement with the fixing belt 105.

In the present exemplary embodiment, swing deviation control is performed to stabilize the deviation movement of the fixing belt 105 within a predetermined deviation range. The swing deviation control refers to a method for tilting the steering roller 132 in a direction opposite to the direction of the deviation movement of the fixing belt 105 when the belt position is detected to have moved more than a predetermined amount from the center in the width direction. Such swing deviation control can be repeated to periodically move the fixing belt 105 from one side to the other in the width direction. This enables stable control of the deviation movement of the fixing belt 105. In other words, the fixing belt 105 is configured to be capable of reciprocations in the direction orthogonal to the conveyance direction V of the sheet S.

The upper belt assembly A includes a sensor unit (not illustrated) for detecting an end position of the fixing belt 105. The sensor unit is located on the left side (near side) of the fixing belt 105, close to the steering roller 132. The CPU 10 detects the end position (belt deviation movement position) of the fixing belt 105 by using the sensor unit, and rotates the stepping motor 155 by a predetermined number of rotations in a forward direction (CW) or reverse direction (CCW) accordingly.

As a result, the left steering roller support arm 154 is rotated upward or downward about the shaft portion 131*a* by a predetermined amount of control via the foregoing mechanisms 157, 152, 161, and 151 illustrated in FIGS. 5 and 6. In response, the tilt of the steering roller 132 changes to perform deviation control of the fixing belt 105.

(2-5) Roughing Mechanism of Fixing Belt 105

Next, the roughing mechanism (surface property recovery mechanism) for recovering surface properties of the fixing belt 105 will be described with reference to FIGS. 10A and 10B. In the present exemplary embodiment, a roughing roller 400 is arranged above the drive roller 131 of the upper belt assembly A. The roughing roller 400 serves as a rubbing rotatable member (roughing member) which rubs an outer surface of the fixing belt 105 to recover surface properties of the fixing belt 105. As described above, the roughing roller 400 is effective when areas of the fixing belt 105 touched by the edge portions of a sheet S are locally roughened in the surface as compared to other areas. More specifically, the roughing roller 400 rubs almost the entire longitudinal area of the fixing belt 105. The roughing roller 400 thereby makes the areas locally roughened in the surface and the other areas have approximately the same surface roughness so that a deteriorated state becomes less noticeable. As employed in the present exemplary embodiment, making a deteriorated state less noticeable in this way is referred to as recovering surface properties. Specifically, in the present exemplary embodiment, the surface of the fixing belt 105 locally roughened to a surface roughness Rz of approximately 2.0 is recovered to a surface roughness Rz of 0.5 to 1.0 by the roughing processing (rubbing processing) of the roughing roller 400.

While the roughing roller 400 is so called in the present exemplary embodiment, the role of the roughing roller 400 is to maintain the surface roughness of the fixing belt 105 sufficiently low for a long period of time. This suppresses uneven glossiness of an image as well as a decrease in image glossiness.

The roughing roller 400 is rotatably supported between a pair of right and left roughing (RF) support arms 141 via bearings (not illustrated). The right and left RF support arms 141 are rotatably supported by fixed shafts 142 which are coaxially fixed to the right and left upper side plates 140 of the apparatus casing, respectively.

The roughing roller 400 includes a $\phi$12-mm core of stainless steel. Abrasive grains are densely bonded to the surface of the core via an adhesive layer. Abrasive grains of #1000 to #4000 in mesh scale (granularity) can be used according to target glossiness of an image. Abrasive grains of #1000 in mesh scale (granularity) have an average grain size of approximately 16 μm. Abrasive grains of #4000 in mesh scale (granularity) have an average grain size of approximately 3 μm. The abrasive grains are alumina-based ones (commonly called "Alundum" or "Morundum"). Alumina grains are the most widely used in industries, and have significantly high hardness as compared to that of the surface of the fixing belt 105 and an acute grain shape for excellent abrasive performance. In the present exemplary embodiment, abrasive grains with a mesh scale (granularity) of #2000 (an average grain size of 7 μm) are used.

(2-6) Contacting/Separating Mechanism for Contacting and Separating Roughing Roller In the present exemplary embodiment, the fixing apparatus 100 includes a contacting/separating mechanism (moving mechanism) for contacting and separating the roughing roller 400 against/from the fixing belt 105. The contacting/separating mechanism will be described in detailed below.

The roughing roller 400 is configured so that its shaft portions at both longitudinal ends are pressed toward the fixing belt 105 by a pressing mechanism during rubbing processing. In the present exemplary embodiment, the right and left RF support arms 141 play the role of the pressing mechanism.

RF cams (eccentric cams) 407 are arranged above the respective right and left RF support arms 141. The right and left RF cams 407 have the same shape and are fixed to an RF camshaft 408 with the same phase. The RF camshaft 408 is rotatably supported between the right and left upper side plates 140 of the apparatus casing via bearings. RF separation shafts 406 are fixed to the respective right and left upper side plates 140. RF separation springs 405 are respectively stretched between the RF separation shafts 406 and arm ends of the right and left RF support arms 141 at the side opposite from where the roughing roller 400 is supported.

The right and left RF support arms 141 are constantly biased by the tensile forces of the RF separation springs 405 to rotate about the respective fixed shafts 142 in a direction to lift up the roughing roller 400. The top surfaces of the right and left RF support arms 141 are elastically pressed to the bottom surfaces of the corresponding right and left RF cams 407. As illustrated in FIG. 10B, an RF attachment/detachment gear 409 is fixed to the left end of the RF camshaft 408. The RF attachment/detachment gear 409 meshes with an RF motor gear 411 of an RF pressure motor 410.

In the present exemplary embodiment, the right and left RF cams 407 are normally stopped at a first orientation of an rotational angle where the large protrusions of the right and left RF cams 407 are directed upward as illustrated in FIGS. 3 and 4. In such a state, the right and left RF support arms 141 are in contact with the small protrusions of the respective corresponding RF cams 407. As a result, the roughing roller 400 is held in a separate position at a predetermined distance from the fixing belt 105. In other words, the roughing roller 400 is lifted above the fixing belt 105 and will not act on the fixing belt 105.

Figure 10A:
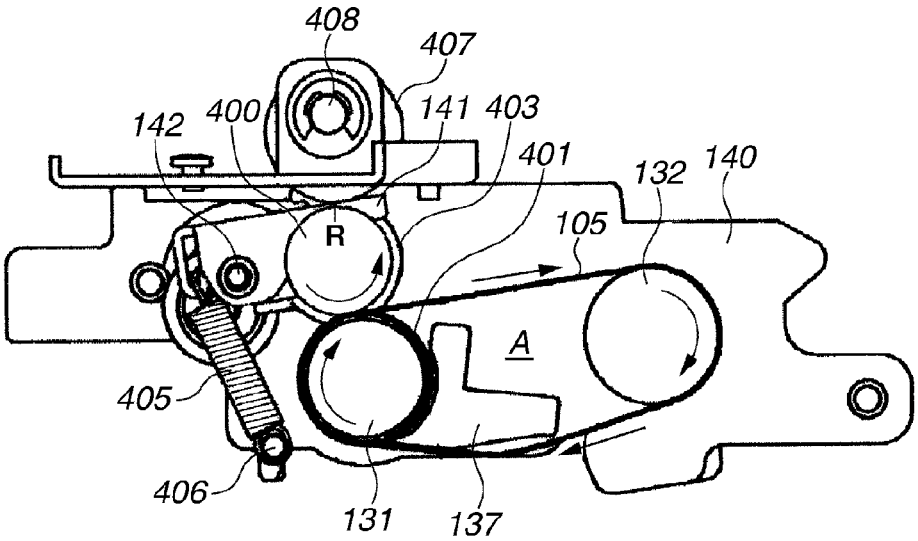
FIGS. 10A and 10B are explanatory diagrams illustrating a roughing mechanism (surface property recovery mechanism).
Figure 10B:
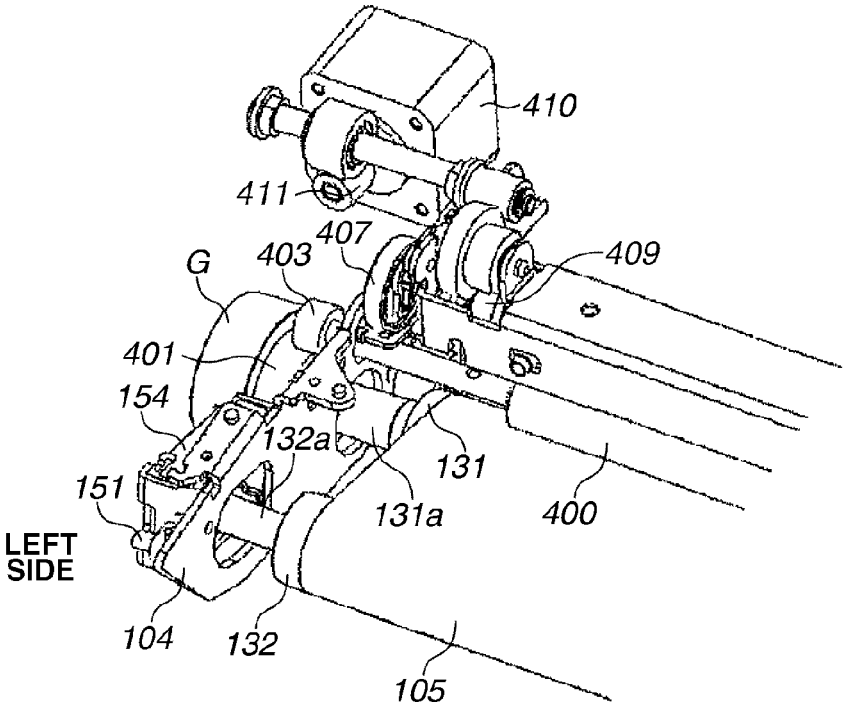

If the right and left RF cams 407 are rotated by 180° from the foregoing first orientation, the right and left RF cams 407 are turned into and held in a second orientation of the rotational angle where the large protrusions are directed downward as illustrated in FIG. 10A. In such a state, the right and left RF support arms 141 are pressed down about the fixed shafts 142 by the respective corresponding RF cams 407 against the RF separation springs 405. As a result, the roughing roller 400 is turned into and held in a pressure position (contact position) where the roughing roller 400 is in touch (contact) with the surface of the fixing belt 105 at a belt wound portion of the drive roller 131 with a predetermined pressing force and forms a roughing nip portion R.

An RF gear 403 fixed to an end of the roughing roller 400 meshes with an RF drive gear 401 fixed to an end of the drive roller 131. The rotational force of the drive roller 131 is then transmitted to the roughing roller 400 through the RF drive gear 401 and the RF gear 403, whereby the roughing roller 400 is rotated in a direction reverse to the fixing belt 105. The roughing roller 400 having the abrasive layer on its surface has the function of rotating with a circumferential speed difference with respect to the fixing belt 105 in the width direction (direction in which the surfaces both move) to evenly roughen the surface (smoothen the surface) of the fixing belt 105.

In other words, the roughing roller 400 serving as a rubbing member is a roller member that rotates with a circumferential speed difference with respect to the fixing belt 105. To switch the position of the roughing roller 400 between the separate position and the pressure position, the RF pressure motor 410 switches the orientation of the right and left RF cams 407 between the first orientation and the second orientation via the RF motor gear 411, the RF attachment/detachment gear 409, and the RF camshaft 408. In FIG. 10A, the lower belt assembly B pressed against the upper belt assembly A to form the fixing nip portion N is omitted.

Figure 11A:
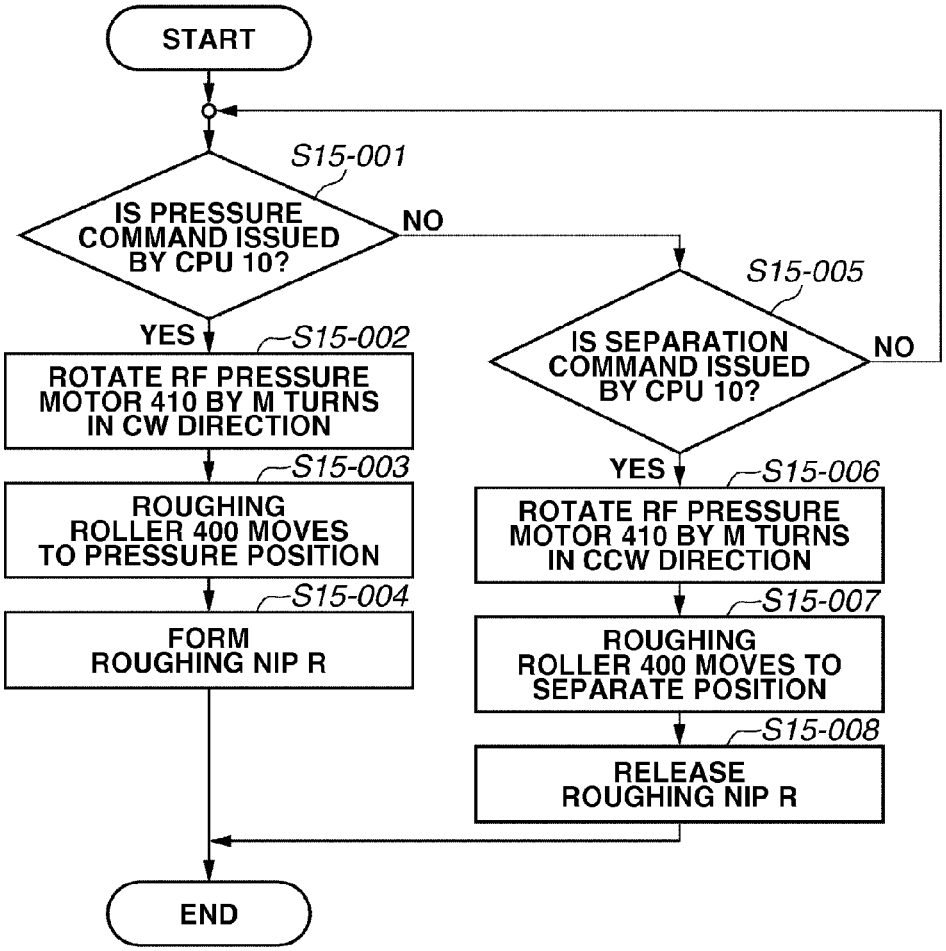
FIG. 11A is a control flowchart of the roughing mechanism.

FIG. 11A is a flowchart illustrating operation control of the foregoing roughing mechanism. As described above, the right and left RF cams 407 of the roughing mechanism are normally stopped at the first orientation of the rotational angle where the large protrusions are directed upward as illustrated in FIGS. 3 and 4. The roughing roller 400 is held in the separate position at a predetermined distance from the fixing belt 105.

Figure 11B:
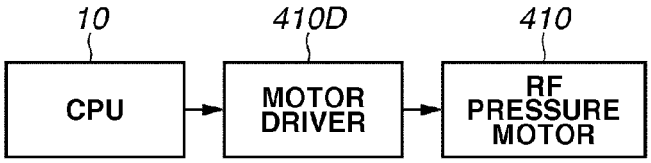
FIG. 11B is a block diagram illustrating a control system.

If the CPU 10 issues a pressure command at predetermined pressure control timing (YES in step S15-001), then in step S15-002, the CPU 10 rotates the RF pressure motor 410 by a predetermined number of rotations, or M turns, in a CW direction via a motor driver 410D (FIG. 11B). In step S15-003, the right and left RF cams 704 are switched from the first orientation (FIGS. 3 and 4) to the second orientation (FIG. 10A), whereby the roughing roller 400 is moved from the separate position (first position) to the pressure position (second position). In step S15-004, with the roughing roller 400 moved to the pressure position, the fixing belt 105 and the roughing roller 400 are pressed to form the roughing nip portion R.

If the CPU 10 issues a separation command at predetermined separation control timing (YES in step S15-005), then in step S15-006, the CPU 10 rotates the RF pressure motor 410 by a predetermined number of rotations, or M turns, in a CCW direction via the motor driver 410D. In step S15-007, the right and left RF cams 407 are switched back from the second orientation (FIG. 10A) to the first orientation (FIGS. 3 and 4), whereby the roughing roller 400 is moved from the pressure position to the separate position. In step S15-008, with the roughing roller 400 moved to the separate position, the fixing belt 105 and the roughing roller 400 are separated to release the roughing nip portion R.

Next, timing to enter a surface property recovery operation of the fixing belt 105 by the roughing roller 400 will be described with reference to FIGS. 12A and 12B. As illustrated in the block diagram of FIG. 12B, in the present exemplary embodiment, the CPU 10 uses a counter W to count the number of sheets S on which the fixing apparatus 100 has performed the fixing processing during the execution of a print job, and stores the cumulative value into a memory Z.

If the cumulative value has reached a predetermined number N of sheets (in the present exemplary embodiment, 3000), the CPU 10 finishes the print job in process or suspends the execution of the print job (fixing processing) before performing the surface property recovery operation of the fixing belt 105 by the roughing roller 400. After the end of the surface property recovery operation, the CPU 10 resets the cumulative value stored in the memory Z to zero. If the print job has been suspended, the CPU 10 resumes the remaining print job after the execution of the surface property recovery operation of the fixing belt 105.

Figure 12A:
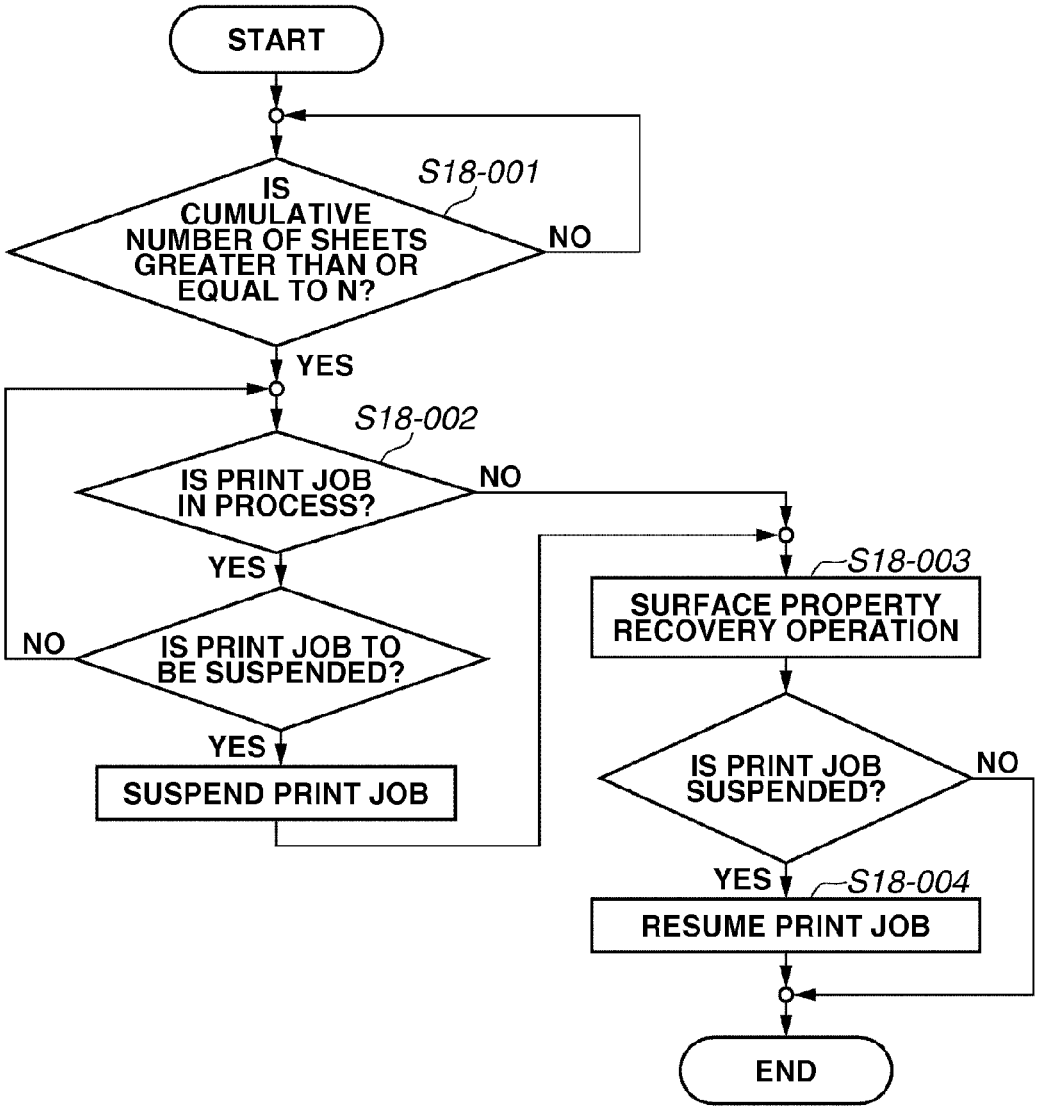
FIG. 12A is a flowchart illustrating a surface property recovery operation.
Figure 12B:
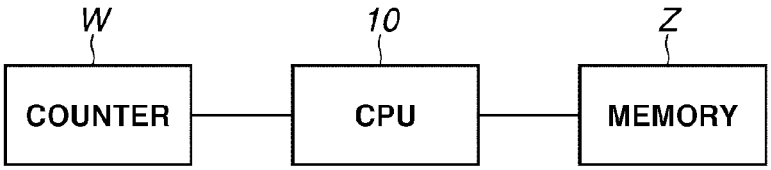
FIG. 12B is a block diagram illustrating a control system.

FIG. 12A is a flowchart illustrating the foregoing surface property recovery operation. If the cumulative number of sheets passed is greater than or equal to the predetermined number of passed sheets N (YES in step S18-001), then in step S18-002, the CPU 10 finishes the print job in process or suspends the print job. In step S18-003, the CPU 10 starts the surface property recovery operation. The CPU 10 also resets the counter W to zero. After the end of the surface property recovery operation, the CPU 10 enters a wait for a next print job. If there is a print job suspended, then in step S18-004, the CPU 10 resumes the suspended print job, and enters a wait for a next print job after the end of the print job.

The present exemplary embodiment has dealt with the case of entering the surface property recovery operation of the fixing belt 105 by the roughing roller 400 after the fixing apparatus 100 has performed the fixing processing on a predetermined number of sheets. This is not restrictive. The CPU 10 may count the number of specific sheets alone. The CPU 10 may perform the surface property recovery operation of the fixing belt 105 on a timely basis like before a print job for a certain type of sheet or in response to a user's operation or instruction from the printer operation unit 24 (FIG. 1) during a print wait.

(2-7) Blowing Mechanism

As described above, when the roughing roller 400 is moved to the pressure position, the fixing belt 105 is rubbed to recover its surface properties. Here, shavings of the surface layer of the fixing belt 105 can be produced in the roughing nip portion R. The shavings may remain on the fixing belt 105 in a line, and the line of shavings extending in the axial direction of the fixing belt 105 may adhere to an image immediately after the roughing operation. Since the image immediately after the roughing operation has high glossiness, the shavings of the surface layer of the fixing belt 105 can appear particularly noticeably, causing a decrease in image quality.

To prevent the shavings of the surface layer of the fixing belt 105 produced by the roughing roller 400 from remaining on the fixing belt 105 in a line and to make shavings appearing on an image immediately after the roughing operation less noticeable, a blowing mechanism is used to diffuse the shavings of the surface layer of the fixing belt 105 during the roughing operation. A shaving diffusing configuration using the blowing mechanism will be described in detail.

Figure 13:
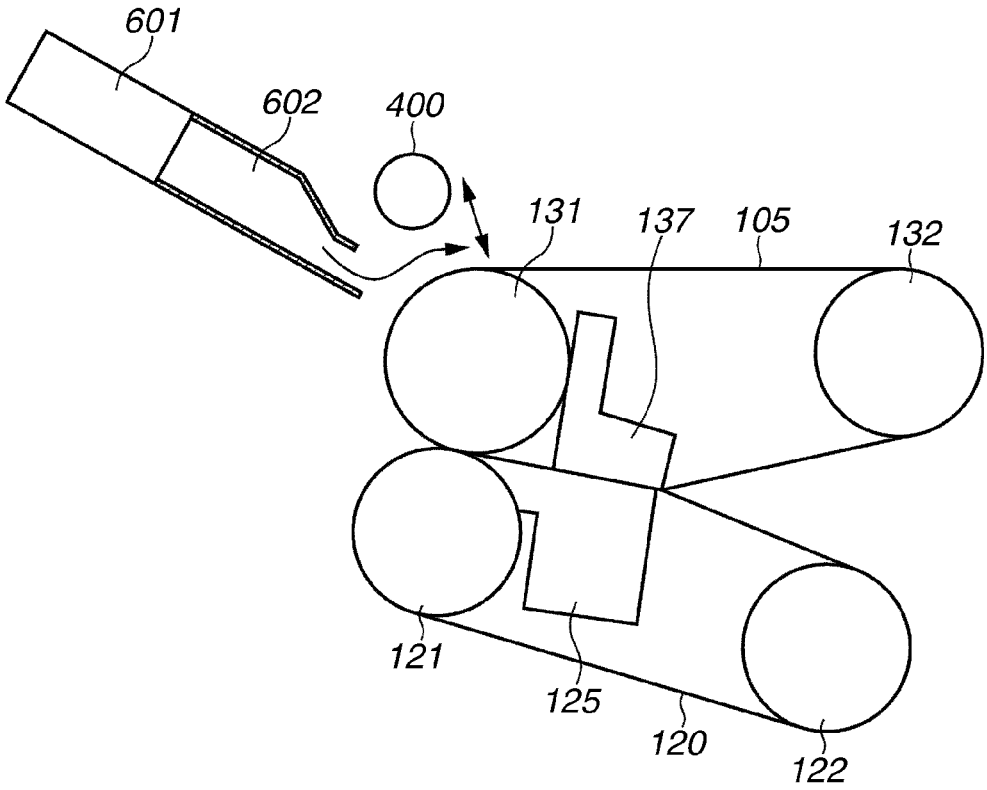
FIG. 13 is a schematic diagram illustrating a blowing mechanism.
Figure 14:
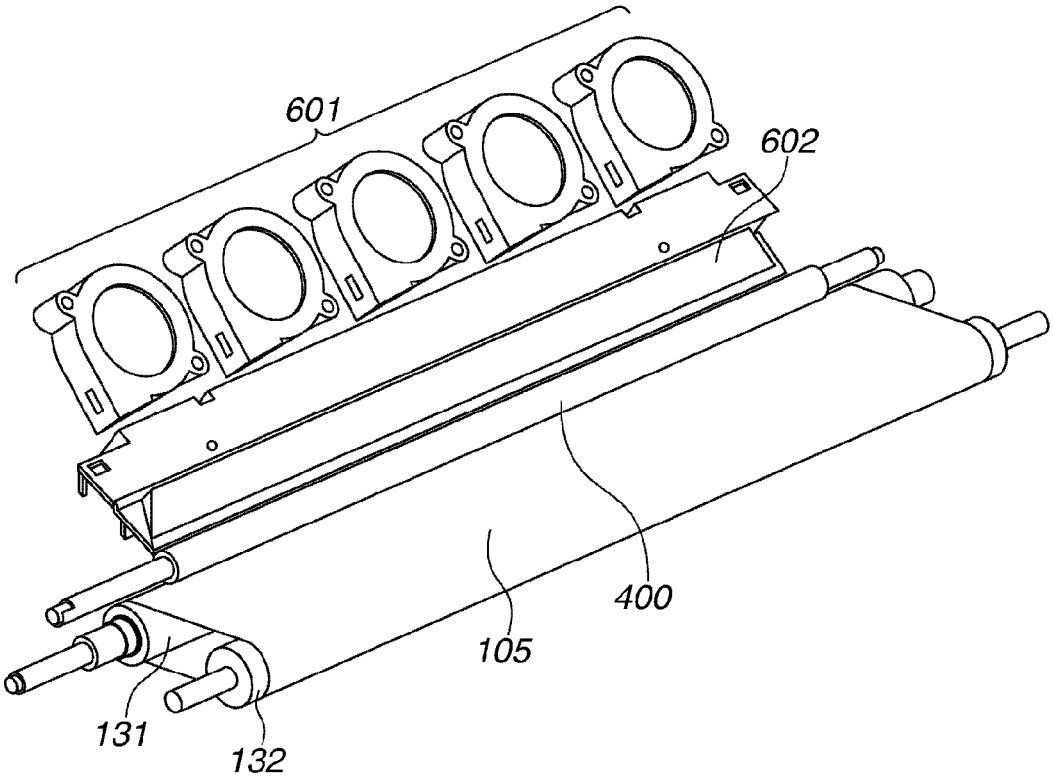
FIG. 14 is a perspective view of the blowing mechanism.
Figure 15:
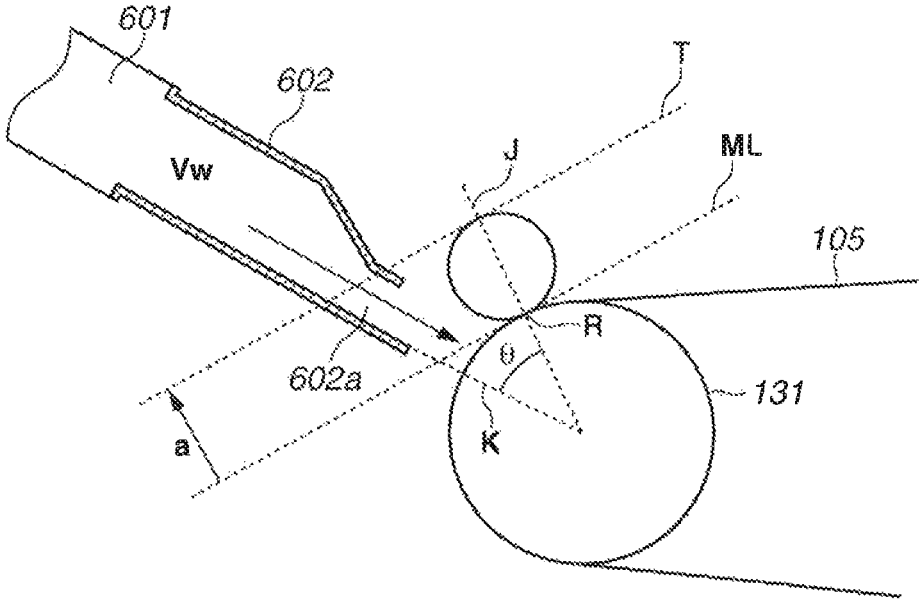
FIG. 15 is a diagram illustrating diffusion of foreign substances in a roughing operation in detail.

FIG. 13 is a schematic diagram illustrating the blowing mechanism according to the present exemplary embodiment. FIG. 14 is a perspective view of the blowing mechanism. FIG. 15 is a schematic diagram illustrating the blowing mechanism. The blowing mechanism includes fans 601 and a duct 602. The CPU 10 serving as a controller controls an operation of the fans 601. When the roughing roller 400 is moved to the pressure position, the fans 601 blow air to the roughing nip portion (contact portion) R between the roughing roller 400 and the fixing belt 105 through the duct 602 so that the air can be blown to the entire longitudinal area (the entire area in the belt width direction) of the fixing belt 105.

In the present exemplary embodiment, when the roughing roller 400 is pressed against (put into contact with) the fixing belt 105, the fans 601 are driven to blow air through the duct 602 at a wind velocity of Vw (for example, 10 m/s) to near the roughing nip portion R formed between the fixing belt 105 and the roughing roller 400. Shavings of the surface layer of the fixing belt 105 occurring during the roughing operation are thereby diffused. This can prevent the shavings of the surface layer of the fixing belt 105 produced by the roughing roller 400 from remaining on the fixing belt 105 in a line, and make shavings appearing on an image immediately after the roughing operation less noticeable.

In the present exemplary embodiment, the roughing roller 400 is located opposite the drive roller 131, which is one of the plurality of support rollers rotatably supporting the fixing belt 105 from inside. The roughing operation is performed by pressing the roughing roller 400 against the drive roller 131 with the fixing belt 105 therebetween.

A description will be given with reference to FIG. 15. In the present exemplary embodiment, the fans 601 are configured to blow air from an upstream side to a downstream side in the rotational direction of the fixing belt 105. The duct 602 is configured to have a blowing opening 602*a* within the range of $45° \leq \theta \leq 60°$, where θ is the angle formed between a line J passing through the two rotation centers (axial centers) of the drive roller 131 and the roughing roller 400 and a wind direction K of the blown air. The duct 602 is thus configured to blow air to the roughing nip portion R. This improves the effect for diffusing the shavings of the surface layer of the fixing belt 105 occurring in the roughing operation.

The blowing opening 602*a* of the duct 602 is installed within a distance a=14 mm, where a is the distance between a nip line ML of the roughing nip portion R formed between the drive roller 131 and the roughing roller 400 and a line T that is drawn in parallel to the nip line ML on a side away from the drive roller 131. Such installation improves the effect for diffusing the shavings of the surface layer of the fixing belt 105 occurring in the roughing operation. As employed herein, the nip line ML refers to a line that connects an inlet portion and an outlet portion of the roughing nip portion R in the width direction of the roughing nip portion R (the rotational direction of the drive roller 131).

Figure 16:
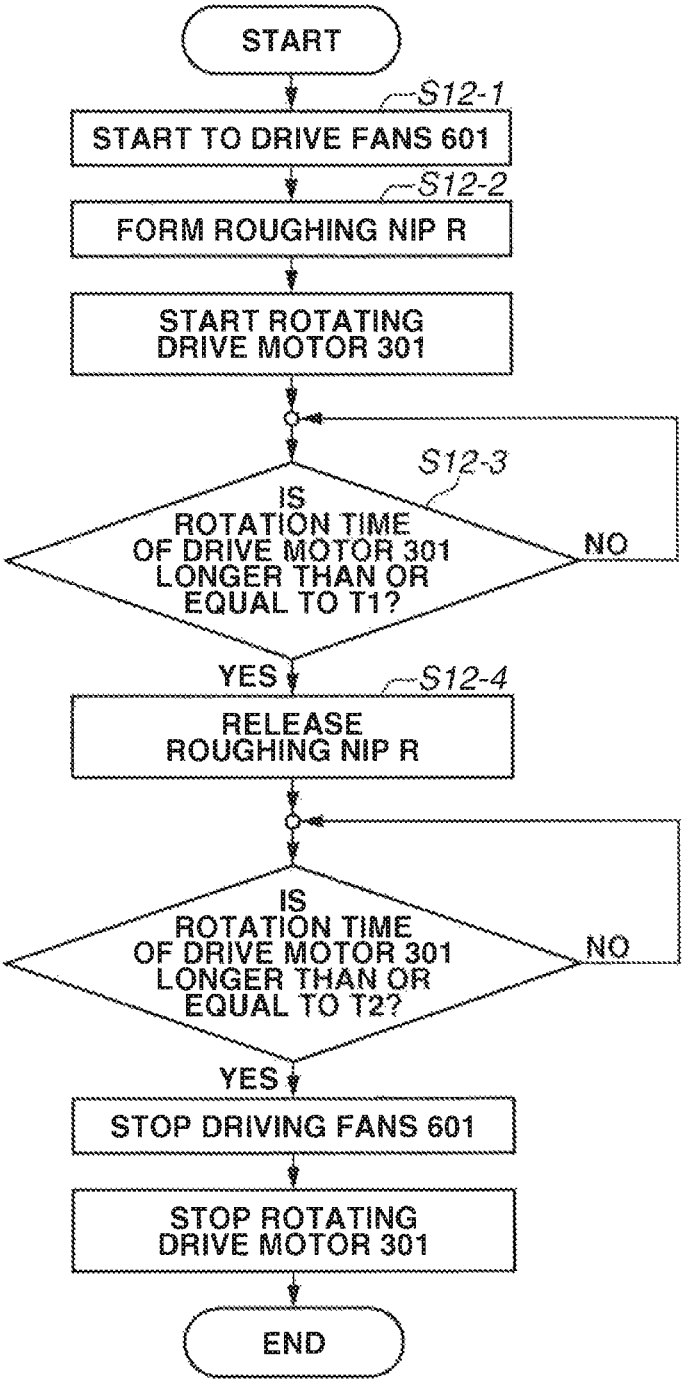
FIG. 16 is a control flowchart illustrating the surface property recovery operation (roughing operation).
Figure 17A:
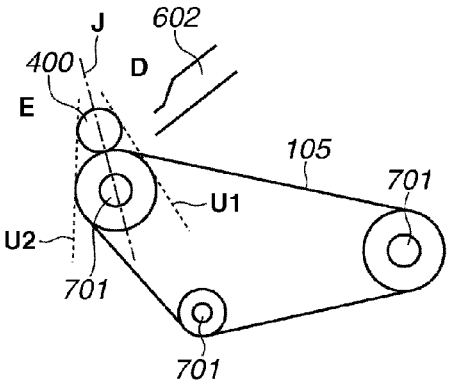
FIGS. 17A, 17B, 17C, and 17D are schematic diagrams illustrating an arrangement of a roughing member and a blowing unit in a fixing apparatus according to a second exemplary embodiment.
Figure 17B:
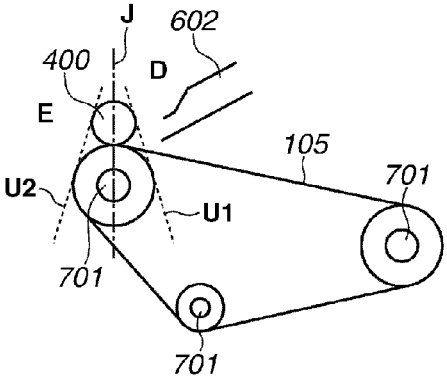
Figure 17C:
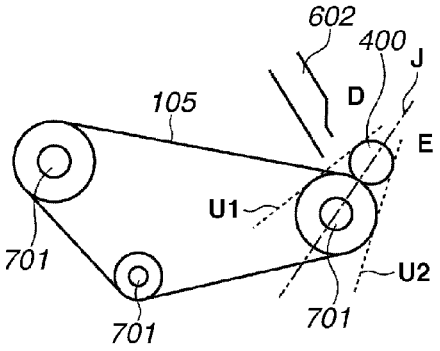
Figure 17D:
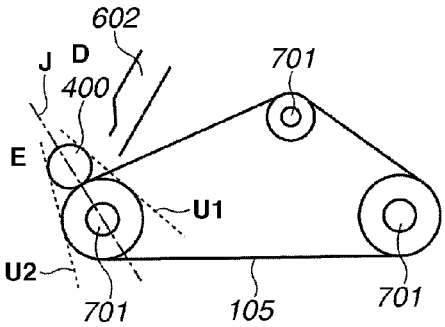

Next, the surface property recovery operation (roughing operation) of the fixing belt 105 will be described in detail with reference to FIG. 16. In step S12-1, the CPU 10 initially starts to drive the fans 601 to blow air. In step S12-2, the CPU 10 moves the roughing roller 400 from the separate position (first position) to the pressure position (second position) to form the roughing nip portion R with the fixing belt 105.

Next, the CPU 10 turns on the drive motor 301 to rotate for a predetermined time T1. In other words, in step S12-3, the CPU 10 rotates the fixing belt 105 for the predetermined time T1. The fans 601 blow air to diffuse shavings produced in the roughing nip portion R, thereby avoiding deposition of the shavings and preventing damage of the roughing roller 400 and the fixing belt 105.

If the predetermined time T1 has elapsed (YES in step S12-3), then in step S12-4, the CPU 10 moves the roughing roller 400 to the separate position to release the formation of the roughing nip portion R with the fixing belt 105. This ends the processing of the surface property recovery operation (rubbing processing) on the surface layer of the fixing belt 105. In the meantime, the fans 601 continue blowing air. Even after the release of the roughing nip portion R, the CPU 10 drives the drive motor 301 to rotate for a predetermined time T2 (for example, 2 sec) to further diffuse shavings remaining on the surface layer of the fixing belt 105. Finally, the CPU 10 stops rotating the drive motor 301 to end the surface property recovery operation of the fixing belt 105.

In the foregoing description, the fans 601 blow air from immediately before the start of the rubbing processing by the roughing roller 400 to immediately after the end of the rubbing processing. However, the blowing of the fans 601 is not limited to such an example. The following configuration may be employed instead.

The present exemplary embodiment is intended to diffuse shavings that may remain on the fixing belt 105 in a line in the longitudinal direction of the fixing belt 105. The fans 601 therefore have only to blow air at least when the roughing roller 400 moves from the pressure position (contact position) to the separate position. The fans 601 may continue blowing air for a predetermined time even after the roughing roller 400 has move from the pressure position to the separate position. This can further diffuse shavings. The fans 601 may start to blow air at timing before the timing when the roughing roller 400 starts to move from the pressure position to the separate position. This can diffuse a certain amount of shavings in advance.

Like the first exemplary embodiment, a fixing apparatus according to a second exemplary embodiment is a fixing apparatus of a belt heating method. The second exemplary embodiment is applied to a belt-type fixing apparatus. In the first exemplary embodiment, the arrangement of the fans 601 and the duct 602 illustrated in FIG. 13 diffuses foreign substances occurring in the roughing operation over the fixing belt 105. As a result, the foreign substances can be made less visible on an image but may still remain on the fixing belt 105.

The present exemplary embodiment defines the positional relationship of the roughing roller 400 with the fans 601 and the duct 602 to sweep away the foreign substances occurring in the roughing operation and prevent the foreign substances from remaining on the fixing belt 105.

FIGS. 17A to 17D each are a schematic diagram illustrating an arrangement of the roughing roller 400 and the duct 602 in a belt-type fixing apparatus in which the fixing belt 105 is suspended across three suspension rollers 701 serving as a plurality of suspension members.

Like the first exemplary embodiment, the roughing roller 400 is located opposite a suspension roller 701 corresponding to the drive roller 131 and is in contact with the fixing belt 105. Suppose two common tangents U1 and U2 to the suspension roller 701 and the roughing 400 are drawn not to intersect a line J that connects the axial centers of the two rollers 701 and 400. With respect to the line J connecting the axial centers of the two rollers 701 and 400, an area where either one of the common tangents U1 and U2 intersects the fixing belt 105 will be referred to as D. An area where neither of the common tangents U1 and U2 intersects the fixing belt 105 will be referred to as E. The fans 601 and the duct 602 are arranged on the D side and blow air to the E side.

More specifically, the fans 601 and the duct 602 are arranged in the area (area D) where a common tangent intersects the fixing belt 105. With such a configuration, any of the arrangements illustrated in FIGS. 17A to 17D can sweep away the foreign substances occurring in the roughing operation and prevent the foreign substances from remaining on the fixing belt 105.

Figure 18A:
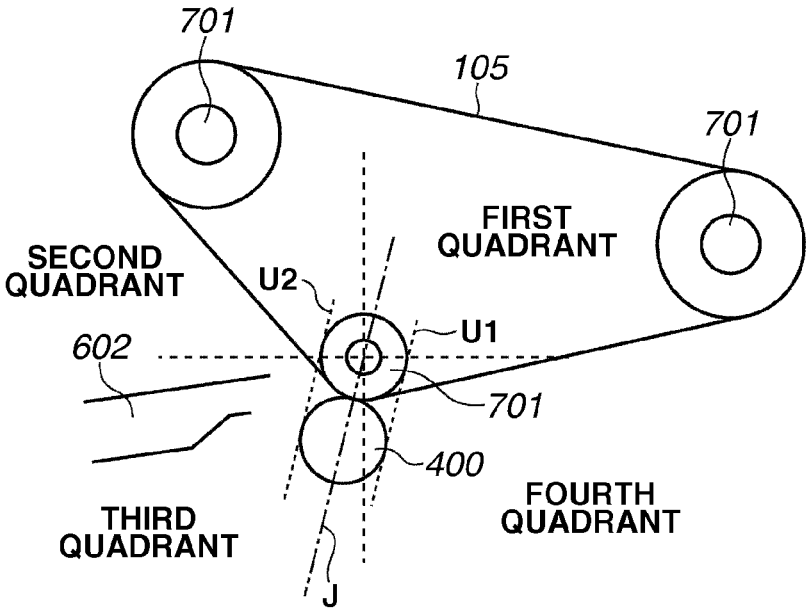
FIGS. 18A and 18B are schematic diagrams illustrating an arrangement of the roughing member and the blowing unit in the fixing apparatus according to the second exemplary embodiment.
Figure 18B:
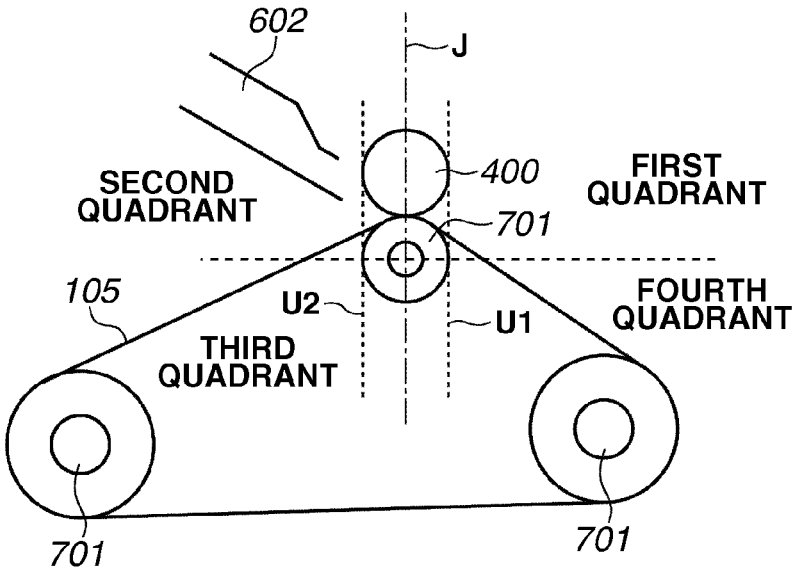

If the two common tangents U1 and U2 of the suspension roller 701 and the roughing roller 400 both intersect the fixing belt 105 as illustrated in FIGS. 18A and 18B, the foreign substance sweeping effect can be obtained in the following case. Take, as illustrated in FIG. 18A, a coordinate system with respect to the axis of the suspension roller 701 located opposite the roughing roller 400. If the roughing roller 400 lies in the third or fourth quadrant of the coordinate system, the air blowing provides a favorable foreign substance sweeping effect. The duct 602 may be arranged in either of the third and fourth quadrants.

If the roughing roller 400 lies in the first or second quadrant of the foregoing coordinate system as illustrated in FIG. 18B, foreign substances are not able to be swept off the fixing belt 105. Such an arrangement shall be avoided.

As described above, even in the present exemplary embodiment, shavings of the surface layer of the fixing belt 105 produced by the roughing roller 400 can be prevented from remaining on the fixing belt 105 in a line. Shavings appearing on an image immediately after a roughing operation can thus be made less noticeable.

While the exemplary embodiments of the present invention have been described above, various configurations described above may be replaced with known ones without departing from the scope of the concept of the present invention.

For example, the foregoing exemplary embodiments have been described by using the fixing belt 105 as an example of the member for the roughing roller 400 to perform the rubbing processing on. However, an exemplary embodiment of the present invention is not limited thereto, and may be similarly applied to a case where a roughing roller 400 performs rubbing processing on the pressure belt 120. Such an application is particularly effective when images are formed on both sides of a sheet S.

The foregoing exemplary embodiments have been described by using a fixing apparatus including the fixing belt 105 and the pressure belt 120 as an example. However, an exemplary embodiment of the present invention is not limited thereto, and may be similarly applied to cases where a fixing roller is used instead of the fixing belt 105, and where a pressure roller or a nonrotating pad having a small surface friction coefficient is used instead of the pressure belt 120.

The foregoing exemplary embodiments have been described by using a fixing apparatus that fixes an unfixed toner image to a sheet S as an example. However, an exemplary embodiment of the present invention is not limited thereto, and may be similarly applied to an apparatus that heats and presses a toner image that has been temporarily fixed to a sheet (even in such a case, the apparatus is referred to as a fixing apparatus).

The foregoing exemplary embodiments have dealt with a heating mechanism of electromagnetic induction heating method. However, an exemplary embodiment of the present invention is not limited thereto, and may be similarly applied to cases where heating mechanisms of other methods such as a halogen heater are used. Specifically, for example, a heating mechanism such as a halogen heater may be arranged inside the drive roller 131 and/or the pressure roller 121.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-087255 filed Apr. 6, 2012, which is hereby incorporated by reference herein in its entirety.

What is claimed is:

1. A fixing apparatus comprising:

first and second fixing rotatable members configured to fix a toner image on a sheet at a nip portion therebetween;

a rubbing rotatable member configured to rub an outer surface of the first fixing rotatable member;

a moving mechanism configured to move the rubbing rotatable member between a contact position where the rubbing rotatable member is in contact with the outer surface of the first fixing rotatable member, and a separate position where the rubbing rotatable member is away from the outer surface of the first fixing rotatable member; and an air blowing mechanism configured to blow air between the rubbing rotatable member and the first fixing rotatable member at least when the rubbing rotatable member moves from the contact position to the separate position.

2. The fixing apparatus according to claim 1, wherein the air blowing mechanism is configured to continue blowing air between the rubbing rotatable member and the first fixing rotatable member for a predetermined time after the rubbing rotatable member has moved from the contact position to the separate position.

3. The fixing apparatus according to claim 2, wherein the air blowing mechanism starts to blow air between the rubbing rotatable member and the first fixing rotatable member before the rubbing rotatable member starts to move to the separate position.

4. The fixing apparatus according to claim 1, wherein the air blowing mechanism is configured to blow air from an upstream side to a downstream side in a rotational direction of the first fixing rotatable member.

5. The fixing apparatus according to claim 1, wherein the rubbing rotatable member has abrasive grains of #1000 to #4000 in mesh scale bonded to a surface thereof.

6. The fixing apparatus according to claim 1, wherein the rubbing rotatable member is configured to perform rubbing processing so that the first fixing rotatable member has a surface roughness Rz of 0.5 to 1.0.

7. The fixing apparatus according to claim 1, further comprising a counter configured to count a number of sheets on which image heating processing is performed, wherein the rubbing rotatable member is configured to perform rubbing processing if the number of sheets counted by the counter reaches a predetermined value.

8. The fixing apparatus according to claim 7, wherein the rubbing rotatable member is configured to perform the rubbing processing when the image heating processing is not performed.

9. The fixing apparatus according to claim 1, wherein the first fixing rotatable member includes an endless belt having an inner surface rotatably supported by a support roller, and wherein the moving mechanism is configured to move the rubbing rotatable member to the contact position so that the endless belt is sandwiched between the rubbing rotatable member and the support roller.

10. The fixing apparatus according to claim 9, wherein the rubbing rotatable member includes a rubbing roller, and wherein the air blowing mechanism is configured to blow air so that $45° \leq \theta \leq 60°$ is satisfied, where $\theta$ is an angle formed between a blowing direction of the air and a line passing through center axes of the support roller and the rubbing roller.

* * * * *